US008104307B2

(12) United States Patent
Hasegawa et al.

(10) Patent No.: US 8,104,307 B2
(45) Date of Patent: Jan. 31, 2012

(54) EXPANDER-INTEGRATED COMPRESSOR AND REFRIGERATION-CYCLE APPARATUS WITH THE SAME

(75) Inventors: Hiroshi Hasegawa, Osaka (JP); Takeshi Ogata, Osaka (JP); Masaru Matsui, Kyoto (JP); Atsuo Okaichi, Osaka (JP); Masanobu Wada, Osaka (JP); Yasufumi Takahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 497 days.

(21) Appl. No.: 12/438,232

(22) PCT Filed: Aug. 21, 2007

(86) PCT No.: PCT/JP2007/066177

§ 371 (c)(1),
(2), (4) Date: Feb. 20, 2009

(87) PCT Pub. No.: WO2008/023694

PCT Pub. Date: Feb. 28, 2008

(65) Prior Publication Data

US 2010/0180628 A1 Jul. 22, 2010

(30) Foreign Application Priority Data

Aug. 22, 2006 (JP) ..... 2006-224856
Aug. 22, 2006 (JP) ..... 2006-224857

(51) Int. Cl.

| | |
|---|---|
| ***F25B 43/02*** | (2006.01) |
| ***F01C 1/02*** | (2006.01) |
| ***F01C 21/04*** | (2006.01) |
| ***F01C 21/06*** | (2006.01) |

(52) U.S. Cl. ..... 62/468; 418/63; 418/94; 418/102

(58) Field of Classification Search ..... 62/468; 418/83, 11, 13, 60, 5, 215, 3, 102, 94, 63
See application file for complete search history.

(56) References Cited

U.S. PATENT DOCUMENTS

| | | | |
|---|---|---|---|
| 2,130,349 | A | 9/1938 | Kucher |
| 5,322,424 | A | 6/1994 | Fujio |
| 2005/0053506 | A1 | 3/2005 | Cho et al. |
| 2007/0053782 | A1 | 3/2007 | Okamoto et al. |
| 2008/0232992 | A1 | 9/2008 | Okamoto et al. |

FOREIGN PATENT DOCUMENTS

| | | | |
|---|---|---|---|
| EP | 2 034 131 | | 3/2009 |
| JP | 2000-073974 | | 3/2000 |
| JP | 2000-087892 | | 3/2000 |
| JP | 2003-139059 | A | 5/2003 |
| JP | 2005-106046 | A | 4/2005 |
| JP | 2007-162679 | A | 6/2007 |
| WO | WO 2005/088078 | A | 9/2005 |

*Primary Examiner* — Chen Wen Jiang
(74) *Attorney, Agent, or Firm* — Hamre, Schumann, Mueller & Larson, P.C.

(57) ABSTRACT

An expander-integrated compressor (5A) has a compression mechanism (21) for compressing a refrigerant and an expansion mechanism (22) for expanding the refrigerant. The compression mechanism (21) is located above the expansion mechanism (22) inside a closed casing (10) and shares a rotating shaft (36) with the expansion mechanism (22). An oil pump (37) is provided at the lower end of the rotating shaft (36). The oil pump (37) is immersed in oil in an oil reservoir (15). Usually, the oil is placed in the oil reservoir (15) in such a manner that the oil level (OL) is located above a lower end portion (34*e*) of a vane (34*a*) of a first expansion section (30*a*). More preferably, the oil is placed in such a manner that the expansion mechanism (22) is immersed in the oil. An oil supply passage (38) for guiding the oil to the compression mechanism (21) is formed inside the rotating shaft (36). A suction port (37*a*) of the oil pump (37) is provided below the lower end portion (34*e*) of the vane (34*a*).

16 Claims, 16 Drawing Sheets

EXPANDER-INTEGRATED COMPRESSOR AND REFRIGERATION-CYCLE APPARATUS WITH THE SAME

TECHNICAL FIELD

The present invention relates to expander-integrated compressors, each of which includes a compression mechanism for compressing a fluid and an expansion mechanism for expanding the fluid, and refrigeration cycle apparatuses with the same.

BACKGROUND ART

Conventionally, an expander-integrated compressor has been known in which a compression mechanism and an expansion mechanism are disposed vertically within a closed casing (see, for example, WO 2005/088078and JP 2003-139059 A).

The expander-integrated compressor disclosed in FIG. 2 of WO 2005/088078 includes a casing formed of a closed casing as well as an expansion mechanism, a motor, and a compression mechanism that are disposed inside the casing. The expansion mechanism, motor, and compression mechanism are disposed sequentially from the upper part toward the lower part. A rotating shaft of the compression mechanism extends upwards, and the expansion mechanism is coupled to this rotating shaft. That is, the rotating shaft of the compression mechanism also is used as the rotating shaft of the expansion mechanism. An oil reservoir is provided in the bottom portion of the casing. An oil pump is provided at the lower end of the rotating shaft, and an oil supply passage is formed inside the rotating shaft. In the expander-integrated compressor, the oil pumped up by the oil pump passes through the oil supply passage to be supplied to each sliding part of the compression mechanism and expansion mechanism.

In the above-mentioned expander-integrated compressor, the rotating shaft penetrates through the compression mechanism to pump the oil up from the oil pump provided at the lower end of the rotating shaft. Accordingly, a rotary compression mechanism often is used as the compression mechanism.

The rotary compression mechanism includes a cylinder, a piston that eccentrically rotates inside the cylinder, and a partition member that partitions the space inside the cylinder into a low-pressure side compression chamber and a high-pressure side compression chamber together with the piston. The partition member slides with respect to the cylinder as the piston rotates eccentrically. In the rotary compression mechanism, since the partition member plays an important role in partition the compression chamber inside the cylinder, it is necessary to supply a sufficient amount of the oil to the partition member to lubricate and seal it.

However, the partition member is provided on the outer circumferential side of the rotary compression mechanism and therefore is located away from the oil supply passage formed inside the rotating shaft. Accordingly, the partition member is not lubricated sufficiently and thereby, for example, seizing may occur due to friction. Furthermore, since insufficient oil supply results in a decrease in sealing force, there also is a possibility that compression performance decreases dramatically.

Therefore, in the expander-integrated compressor described above, in order to solve the shortage in oil supply to the partition member, the rotary compression mechanism is immersed in the oil contained in the oil reservoir and thereby the oil is supplied directly from the oil reservoir to the partition member.

However, the oil contained in the oil reservoir is supplied to the respective sliding parts of both the compression mechanism and the expansion mechanism through the oil supply passage. Furthermore, part of the oil supplied to the respective sliding parts is discharged to the outside of the casing together with a flow of working fluid. Therefore, in the expander-integrated compressor, the oil contained in the oil reservoir tends to be reduced as compared to the case where only a compression mechanism is included. Particularly, for example, at the time of startup of a refrigeration cycle apparatus or at the time of a change in the pressure-temperature conditions, the oil contained in the oil reservoir tends to be reduced. However, in the expander-integrated compressor, since the oil pump is provided at the lower end of the rotating shaft, a predetermined amount of the oil continues to be supplied to the expansion mechanism even after the oil contained in the oil reservoir is reduced. Accordingly, the oil contained in the oil reservoir further is reduced.

When the oil contained in the oil reservoir is reduced and the oil level is lowered, the oil cannot be supplied to the partition member from the oil reservoir. Accordingly, the sealing performance of the compression mechanism deteriorates. This results in unstable operation of the compression mechanism, and thereby the compression efficiency decreases dramatically. Furthermore, the partition member and the cylinder are worn away due to the lack of lubrication. This also decreases the compression efficiency of the compression mechanism.

The compression mechanism serves as a power source for circulating a working fluid of the refrigeration cycle apparatus. Therefore, the effect of the operating condition of the compression mechanism on the refrigeration cycle apparatus is much greater than that of the expansion mechanism on the refrigeration cycle apparatus. Accordingly, when the operation of the compression mechanism becomes unstable, the refrigeration cycle apparatus also becomes unstable, which results in a problem in that the refrigeration capacity decreases.

DISCLOSURE OF INVENTION

The present invention was made in view of these points and is intended to prevent operational instability caused by the shortage of lubricating oil in an expander-integrated compressor.

An example of the expander-integrated compressor according to the present invention includes: a closed casing in which an oil reservoir for holding oil is formed in a bottom portion; a compression mechanism provided inside the closed casing, and for compressing a fluid and discharging the fluid into the closed casing; an expansion mechanism provided below the compression mechanism inside the closed casing, and for expanding the fluid, the expansion mechanism including a cylinder, a piston for forming a fluid chamber between the cylinder and itself, a groove portion formed in the cylinder, and a partition member inserted slidably in the groove portion to partition the fluid chamber into a high-pressure side fluid chamber and a low-pressure side fluid chamber; a first intake pipe penetrating through the closed casing and connected to a suction side of the compression mechanism; a first discharge pipe connected to the closed casing, with one end thereof being open into the closed casing; a second intake pipe penetrating through the closed casing and connected to a suction side of the expansion mechanism; a second discharge pipe penetrating through the closed casing and connected to a discharge side of the expansion mechanism; a rotating shaft extending vertically, and including an upper rotating portion for rotating the compression mechanism and a lower rotating portion subjected to a torque by the piston of the expansion mechanism; a suction mechanism provided at the lower end of the rotating shaft, having a suction port that draws the oil held in the oil reservoir, and for drawing the oil through the suction port; and an oil supply passage formed inside the rotating shaft, and for guiding the oil drawn by the suction mechanism to the compression mechanism. The suction port of the suction mechanism is formed in a lower position than that of a bottom end of the partition member of the expansion mechanism, and the oil reservoir holds the oil in such a manner that an oil level is higher than the bottom end of the partition member of the expansion mechanism.

In the expander-integrated compressor described above, the compression mechanism is provided above the expansion mechanism. The oil contained in the oil reservoir is supplied to the compression mechanism through the suction mechanism provided at the lower end of the rotating shaft and the oil supply passage formed inside the rotating shaft. On the other hand, the oil reservoir holds the oil in such a manner that the oil level is higher than the bottom end of the partition member of the expansion mechanism and the oil is supplied directly from the oil reservoir to the partition member of the expansion mechanism. Therefore, when the oil level in the oil reservoir is lowered and becomes lower than the bottom end of the partition member, the oil no longer is supplied to the partition member of the expansion mechanism first. This prevents the oil level in the oil reservoir from lowering. On the other hand, since the suction port of the suction mechanism is formed in a lower position than that of the bottom end of the partition member of the expansion mechanism, the oil continues being supplied to the compression mechanism. Accordingly, the above-mentioned expander-integrated compressor makes it possible to supply the oil to the compression mechanism in preference to the expansion mechanism and to prevent operational instability caused by the shortage of lubricating oil in the compression mechanism.

As in the case of the present invention described above, in an expander-integrated compressor with a compression mechanism located above, the oil supplied to the compression mechanism is heated by the compression mechanism while lubricating sliding parts of the compression mechanism. The oil that has lubricated the sliding parts of the compression mechanism then is discharged from the compression mechanism and falls due to gravitational force to be returned to the oil reservoir located in the bottom portion of the closed casing. Therefore, the temperature of the oil contained in the oil reservoir becomes relatively high. On the other hand, in the expansion mechanism, the expanded refrigerant has a relatively low temperature and thereby the temperature of the expansion mechanism becomes low. When the expansion mechanism is immersed in the oil contained in the oil reservoir, heat transfer occurs from the oil contained in the oil reservoir to the expansion mechanism. Such heat transfer is preferably as low as possible since it causes an increase in enthalpy of the refrigerant that is discharged from the expansion mechanism and a decrease in enthalpy of the refrigerant that is discharged from the compression mechanism and thereby it prevents an improvement in the efficiency of the refrigeration cycle apparatus.

In order to prevent heat transfer from the oil contained in the oil reservoir to the expansion mechanism, as shown in FIG. 6(*b*) of JP 2003-139059 A, it is conceivable that the expansion mechanism may be disposed above the oil level in the oil reservoir. However, when such a configuration is employed, the expansion mechanism is located above the oil level constantly. Therefore, in so far as the configuration goes, in which the rotary expansion mechanism is located above the oil level, a certain measure is indispensable to ensure the lubrication of the partition member. Accordingly, the following configuration can be proposed.

Another example of the expander-integrated compressor according to the present invention includes: a closed casing in which an oil reservoir for holding oil is formed in a bottom portion; a compression mechanism provided inside the closed casing, and for compressing a fluid and discharging the fluid into the closed casing; an expansion mechanism provided below the compression mechanism inside the closed casing, and for expanding the fluid, the expansion mechanism including a cylinder, a piston for forming a fluid chamber between the cylinder and itself, a groove portion formed in the cylinder, a partition member inserted slidably in the groove portion to partition the fluid chamber into a high-pressure side fluid chamber and a low-pressure side fluid chamber, and a rear chamber that is formed in the cylinder on a rear side of the partition member and that communicates with the groove portion; a first intake pipe penetrating through the closed casing and connected to a suction side of the compression mechanism; a first discharge pipe connected to the closed casing, with one end thereof being open into the closed casing; a second intake pipe penetrating through the closed casing and connected to a suction side of the expansion mechanism; a second discharge pipe penetrating through the closed casing and connected to a discharge side of the expansion mechanism; a rotating shaft extending vertically, and including an upper rotating portion for rotating the compression mechanism and a lower rotating portion subjected to a torque by the piston of the expansion mechanism; a suction mechanism provided at the lower end of the rotating shaft, and for drawing the oil from the oil reservoir; and an oil supply passage for supplying the oil drawn by the suction mechanism to the rear chamber of the expansion mechanism.

In the expander-integrated compressor, the oil contained in the oil reservoir that has been drawn by the suction mechanism passes through the oil supply passage and then is supplied to the rear chamber provided on the rear side of the partition member of the expansion mechanism. Furthermore, the oil supplied to the rear chamber flows inside the groove portion from the rear side toward the leading end side of the partition member due to the pressure difference between the inside and the outside of the fluid chamber. Therefore, even when the oil reservoir contains a small amount of the oil and the expansion mechanism is not immersed in the oil reservoir, the oil can be supplied to the whole region extending from the rear side end to the leading end of the partition member of the expansion mechanism. Accordingly, the partition member can be lubricated sufficiently, and the gap between the partition member and the groove portion can be sealed well. This makes it possible to maintain reliability and efficiency of the expansion mechanism. Moreover, oil supply to the compression mechanism also is carried out by the suction mechanism provided at the bottom end of the rotating shaft. Therefore, even when the oil reservoir holds the oil in such a manner that the oil level is lower than the bottom end of the cylinder of the expansion mechanism, both the compression mechanism and the expansion mechanism can be lubricated reliably, which in turn stabilizes the operation of the expander-integrated compressor. Furthermore, since it is not necessary to immerse the expansion mechanism in the oil reservoir, heat transfer from the oil to the fluid in the expansion mechanism can be prevented.

DESCRIPTION OF THE PREFERRED EMBODIMENTS

Figure 1:
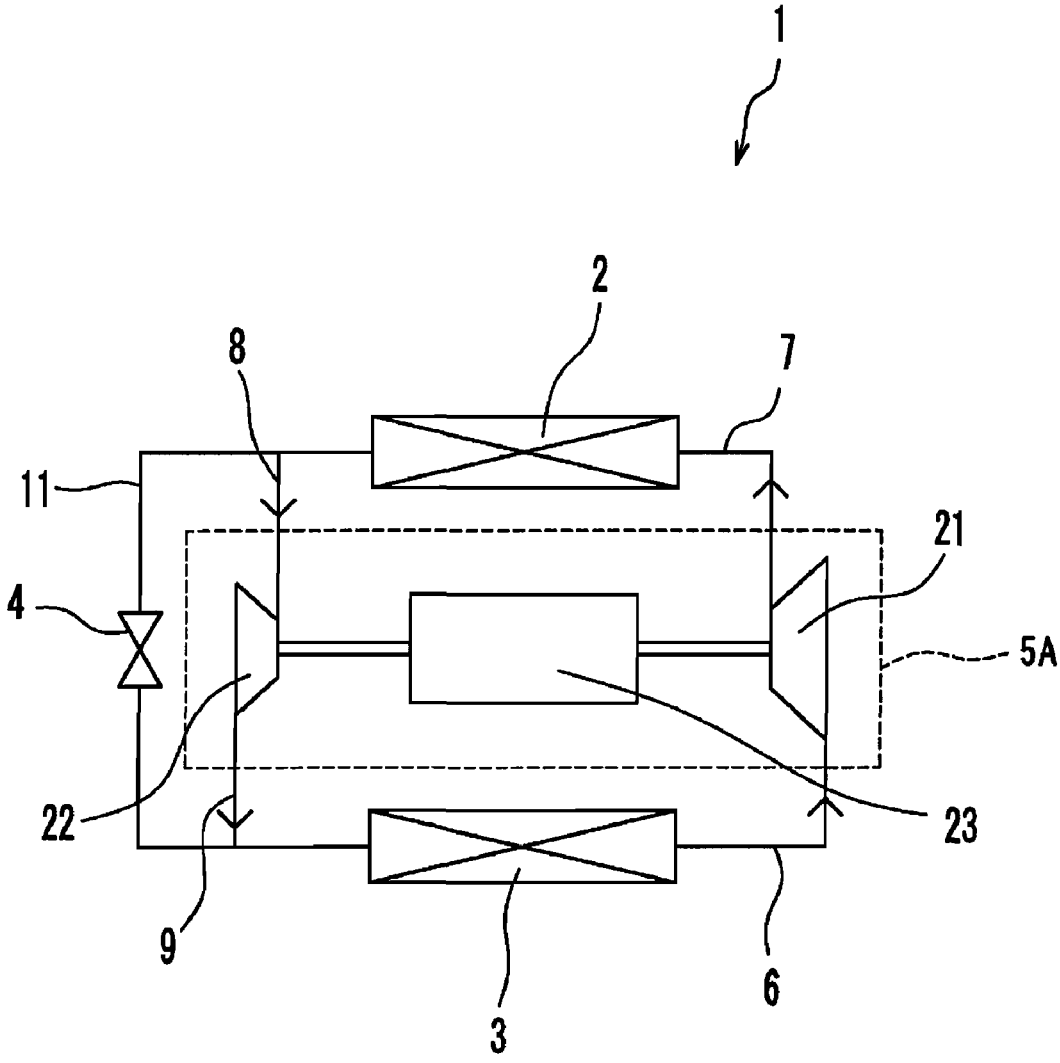
FIG. 1 is a drawing of a refrigerant circuit in which an expander-integrated compressor according to a first embodiment is incorporated.

With respect to an expander-integrated compressor configured so that the expansion mechanism is immersed in the oil contained in the oil reservoir, a preferred embodiment is exemplified as follows.

First, it is preferable that at least the cylinder of the expansion mechanism be immersed in the oil contained in the oil reservoir.

This allows the oil to be supplied to the partition member of the expansion mechanism reliably. Accordingly, the expansion efficiency can be prevented from deteriorating.

Preferably, the second intake pipe of the expansion mechanism is disposed below the bottom end of the partition member.

In the aforementioned expander-integrated compressor, the oil supplied to the compression mechanism is returned to the oil reservoir after lubricating the sliding parts of the compression mechanism. Alternatively, the oil is discharged inside the closed casing together with a discharge refrigerant and then is separated from the refrigerant inside the closed casing to be returned to the oil reservoir. Therefore, the temperature of the oil contained in the oil reservoir becomes relatively high. On the other hand, the refrigerant with a relatively low temperature is supplied to the expansion mechanism.

In the aforementioned expander-integrated compressor, the second intake pipe is disposed below the bottom end of the partition member. Furthermore, the oil reservoir holds the oil in such a manner that the oil level is higher than the bottom end of the partition member. This allows the second intake pipe to be immersed in the oil contained in the oil reservoir. Therefore, heat is transferred from the high temperature oil contained in the oil reservoir to the low temperature refrigerant in the second intake pipe, and thereby the refrigerant to be drawn into the expansion mechanism is heated. As a result, the enthalpy of the fluid to be drawn into the expansion mechanism increases and the recovery power of the expansion mechanism increases.

Furthermore, it is preferable that the second discharge pipe be disposed above the oil level in the oil reservoir.

This makes it possible to prevent heat transfer from the oil contained in the oil reservoir to the refrigerant in the second discharge pipe (refrigerant discharged from the expansion mechanism). Therefore, the aforementioned expander-integrated compressor makes it possible to reduce the decrease in heat absorption ability in an evaporator built into the refrigeration cycle and to improve the refrigeration performance of the refrigeration cycle.

Preferably, the compression mechanism is a scroll compressor.

The aforementioned expander-integrated compressor uses a scroll compressor as the compression mechanism. Since the scroll compressor does not include a partition member as in a rotary compressor, the operation of the compression mechanism can be stabilized.

Furthermore, the expansion mechanism can include a lower expansion section including a first cylinder and a first piston, and an upper expansion section that includes a second cylinder and a second piston, with sizes of the second cylinder and the second piston being determined so that a fluid chamber is formed to be larger in volume than the fluid chamber formed by the first cylinder and the first piston. The low-pressure side fluid chamber of the lower expansion section communicates with the high-pressure side fluid chamber of the upper expansion section, and it is advantageous that the second intake pipe is connected to the expansion mechanism in such a manner that a fluid to be expanded is drawn into the fluid chamber (first fluid chamber) of the lower expansion section while the second discharge pipe is connected to the expansion mechanism in such a manner that the expanded fluid is discharged from the fluid chamber (second fluid chamber) of the upper expansion section. Preferably, the oil reservoir holds the oil in such a manner that the oil level is higher than at least the bottom end of the partition member of the lower expansion section.

From the viewpoint of preventing heat transfer from the oil to the refrigerant, it is desirable that the second discharge pipe, through which the expanded refrigerant is discharged, be disposed in a location away from the oil reservoir. Furthermore, from the viewpoints of preventing heat transfer and suppressing pressure loss, it is preferable that the refrigerant expansion passage (overall length of the flow passage) provided inside the expansion mechanism be short.

In the aforementioned expander-integrated compressor, the second fluid chamber is provided above the first fluid chamber, and the expanded fluid is discharged from the second fluid chamber located on the upper side toward the second discharge pipe. Accordingly, when the height of the oil level is set above the bottom end of the partition member of the upper expansion section and below the second discharge pipe, the second discharge pipe can be disposed in a location away from the oil reservoir and the oil can be supplied to the partition member of each expansion section. Furthermore, according to the configuration in which the expanded fluid is discharged from the second fluid chamber located on the upper side toward the second discharge pipe, it is not necessary to provide a bypass needlessly for keeping the second discharge pipe away from the oil reservoir and thereby the expansion passage can be shortened. Accordingly, heat transfer from the oil contained in the oil reservoir to the discharge refrigerant of the expansion mechanism can be prevented and the pressure loss of the refrigerant can be suppressed.

However, the expansion mechanism may include an upper expansion section including a first cylinder and a first piston, and a lower expansion section that includes a second cylinder and a second piston, with sizes of the second cylinder and the second piston being determined so that a fluid chamber is formed to be larger in volume than the fluid chamber formed by the first cylinder and the first piston. In this case, it is advantageous that the low-pressure side fluid chamber of the upper expansion section communicates with the high-pressure side fluid chamber of the lower expansion section, the second intake pipe is connected to the expansion mechanism so that the fluid to be expanded is drawn into the fluid chamber (first fluid chamber) of the upper expansion section, and the second discharge pipe is connected to the expansion mechanism so that the expanded fluid is discharged from the fluid chamber (second fluid chamber) of the lower expansion section. Preferably, the oil reservoir holds the oil in such a manner that the oil level is higher than at least the bottom end of the partition member of the lower expansion section.

Shortage of oil supply to the partition member results in a deterioration in sealing performance and thereby the refrigerant leaks from each fluid chamber. Furthermore, the pressure difference between the inside and the outside of the second fluid chamber is larger than that between the inside and the outside of the first fluid chamber inside the expansion mechanism. Therefore, when the sealing performance of the partition member that partitions the second fluid chamber deteriorates, more refrigerant leaks as compared to the case where the sealing performance of the partition member that partitions the first fluid chamber deteriorates. This results in a deterioration in performance of the expansion mechanism.

However, in the expander-integrated compressor, the second fluid chamber is provided below the first fluid chamber. Therefore, even when the oil contained in the oil reservoir is reduced and the oil level is lowered, the oil is prevented from being supplied to the partition member that partitions the first fluid chamber first, and the oil level is prevented from being lowered. Therefore, the aforementioned expander-integrated compressor makes it possible to avoid the shortage of oil supply to the partition member that partitions the second fluid chamber and to prevent the performance of the expansion mechanism from deteriorating.

The expansion mechanism can have a rear chamber that is formed in the cylinder on the rear side of the partition member and that communicates with the groove portion. In this case, it is preferable that the expander-integrated compressor include a bearing that supports the lower rotating portion of the rotating shaft, a first oil supply passage that is formed on the outer circumferential side of the lower rotating portion or on the inner circumferential side of the bearing and that upwardly supplies the oil drawn by the suction mechanism, and a second oil supply passage for supplying the oil that has passed through at least a part of the first oil supply passage to the groove portion or the rear chamber.

In the expander-integrated compressor described above, the oil contained in the oil reservoir that has been drawn by the suction mechanism is guided to the first oil supply passage. The oil located in the first oil supply passage then flows into the second oil supply passage and then is supplied to the groove portion where the partition member of the expansion mechanism is provided. Therefore, the oil contained in the oil reservoir is supplied sufficiently to the partition member of the expansion mechanism through the first oil supply passage and the second oil supply passage. Accordingly, the shortage in lubrication to the partition member can be prevented and the gap between the partition member and the groove portion can be sealed.

Preferably, the bearing has an upper bearing that supports a portion of the lower rotating portion located above the cylinder, an upper communication hole that extends from the first oil supply passage to the groove portion is formed inside the upper bearing, and the second oil supply passage is configured by the upper communication hole.

The expander-integrated compressor described above allows the second oil supply passage to be formed with a simple configuration. Accordingly, with a simple configuration, it becomes possible to lubricate the partition member, and the gap between the partition member and the groove portion can be sealed.

Preferably, the bearing has a lower bearing that supports a portion of the lower rotating portion located below the cylinder, a lower communication hole that extends from the first oil supply passage to the groove portion is formed inside the lower bearing, and the second oil supply passage portion is configured by the lower communication hole.

The expander-integrated compressor described above allows the second oil supply passage to be formed with a simple configuration. Accordingly, with a simple configuration, it becomes possible to lubricate the partition member, and the gap between the partition member and the groove portion can be sealed.

Preferably, the bearing has an upper bearing that supports a portion of the lower rotating portion located above the cylinder, an upper through hole, which extends from an upper face of the upper bearing to the rear chamber and that guides, to the rear chamber, the oil that has flowed out to the upper face of the upper bearing from the first oil supply passage, is formed in the upper bearing, and the second oil supply passage is configured by the upper through hole.

The oil contained in the oil reservoir is supplied continuously to the first oil supply passage of the expander-integrated compressor by the suction mechanism and then flows out from the top end portion thereof to the upper face of the upper bearing. The oil that has flowed out to the upper face of the upper bearing is supplied through the upper through hole to the rear chamber provided on the rear side of the partition member. The oil supplied to the rear chamber flows from the rear side toward the leading end side of the partition member inside the groove portion due to the pressure difference between the inside and the outside of the fluid chamber. In this manner, the oil is supplied forcibly to the groove portion where the partition member has been inserted, through the first oil supply passage, upper through hole, and rear chamber. Therefore, according to the expander-integrated compressor, even when the oil level in the oil reservoir is lowered, the oil can be supplied to the partition member reliably.

Preferably, an oil supply groove that guides the oil from the first oil supply passage to the upper through hole is formed in the upper face of the upper bearing.

This makes it easy for the oil, which has flowed out to the upper face of the upper bearing from the first oil supply passage, to flow into the upper through hole. Therefore, the oil can be supplied more reliably to the partition member of the expansion mechanism.

Preferably, the fluid that is used in the expander-integrated compressor is carbon dioxide.

Generally, since oil can blend into carbon dioxide in a supercritical state relatively easily, an oil shortage tends to occur when carbon dioxide is used as a working fluid. However, as described above, the aforementioned expander-integrated compressor makes it possible to supply a sufficient amount of the oil to the compression mechanism and thereby to prevent an oil shortage effectively. Accordingly, even when carbon dioxide is used as a working fluid, operational instability caused by the shortage of the lubricating oil can be prevented.

Next, with respect to an expander-integrated compressor provided with an oil supply passage for supplying the oil drawn by the suction mechanism to the rear chamber formed on the rear side of the partition member, a preferred embodiment will be described as an example.

The expander-integrated compressor further may include a bearing that supports the lower rotating portion of the rotating shaft. In this case, it is preferable that the oil supply passage be provided with a first oil supply passage that is formed on the outer circumferential side of the lower rotating portion or on the inner circumferential side of the bearing and that upwardly supplies the oil drawn by the suction mechanism, and a second oil supply passage for supplying the oil that has passed through at least a part of the first oil supply passage, to the rear chamber.

In the expander-integrated compressor described above, the oil contained in the oil reservoir that has been drawn by the suction mechanism is guided to the first oil supply passage. The oil located in the first oil supply passage then flows into the second oil supply passage and subsequently is supplied to the rear chamber provided on the rear side of the partition member of the expansion mechanism. Therefore, as described above, the oil contained in the oil reservoir is supplied sufficiently to the partition member of the expansion mechanism through the first oil supply passage and the second oil supply passage. Accordingly, the lack of lubrication with respect to the partition member can be prevented, and furthermore, the gap between the partition member and the groove portion can be sealed well.

It is preferable that the bearing have an upper bearing that supports a portion of the lower rotating portion located above the cylinder, an upper through hole that extends from the upper face of the upper bearing to the rear chamber and that guides the oil that has flowed out to the upper face of the upper bearing from the first oil supply passage, to the rear chamber be formed in the upper bearing, and the second oil supply passage be configured by the upper through hole.

The oil contained in the oil reservoir is supplied continuously to the first oil supply passage of the expander-integrated compressor by the suction mechanism. Therefore, the oil drawn by the suction mechanism is guided upward inside the first oil supply passage and then flows out to the upper face of the upper bearing from the contact surface between the upper bearing and the rotating shaft. Since the oil contained in the oil reservoir has a relatively high temperature, the oil that has flowed out to the upper face of the upper bearing also has a high temperature. When such a high temperature oil is pooled on the upper face of the upper bearing, there is concern that heat is transferred from the oil to the upper bearing and thereby is transferred to the fluid located inside the expansion mechanism.

However, the upper bearing of the expander-integrated compressor is provided with the upper through hole. Accordingly, the oil that has flowed out to the upper face of the upper bearing from the first oil supply passage flows into the rear chamber provided on the rear side of the partition member through the upper through hole. Therefore, the aforementioned expander-integrated compressor makes it possible to supply the oil to the partition member and to prevent the oil from pooling on the upper face of the upper bearing. Thus, the aforementioned expander-integrated compressor makes it possible to supply a sufficient amount of the oil to the partition member of the expansion mechanism and to prevent heat from being transferred from the oil to the fluid in the expansion mechanism, with a simple configuration.

Furthermore, it is preferable that the expander-integrated compressor include a cover that integrally covers, above the upper face of the upper bearing, a space around the rotating shaft and a space above the upper through hole.

This allows all of the oil that has flowed out to the upper face of the upper bearing from the first oil supply passage to be guided to the upper through hole. Therefore, the oil can be supplied to the partition member reliably. Furthermore, by covering a part of the upper face of the upper bearing with the cover, the oil that has flowed out from the first oil supply passage can be pooled in a part of the upper face. Accordingly, heat of the oil can be prevented from being transferred to the whole upper face of the upper bearing.

Furthermore, it is preferable that the bearing have an upper bearing that supports a portion of the lower rotating portion located above the cylinder, an upper communication hole that extends from the first oil supply passage to the rear chamber be formed inside the upper bearing, and at least a part of the second oil supply passage be configured by the upper communication hole.

The expander-integrated compressor described above allows a second oil supply passage to be formed with a simple configuration. Therefore, with a simple configuration, it becomes possible to lubricate the partition member, and the gap between the partition member and the groove portion can be sealed.

Moreover, it is preferable that the bearing have a lower bearing that supports a portion of the lower rotating portion located below the cylinder, a lower communication hole that extends from the first oil supply passage to the rear chamber be formed inside the lower bearing, and at least a part of the second oil supply passage be configured by the lower communication hole.

The expander-integrated compressor described above allows a second oil supply passage to be formed with a simple configuration. Therefore, with a simple configuration, it becomes possible to lubricate the partition member, and the gap between the partition member and the groove portion can be sealed.

Furthermore, it is preferable that the bearing have an upper bearing that supports a portion of the lower rotating portion located above the cylinder, and the expansion mechanism include a return passage that guides the oil located on the upper face of the upper bearing to the oil reservoir.

The expander-integrated compressor described above allows the oil that has flowed out from the upper face of the upper bearing to be returned to the oil reservoir through the return passage. Therefore, the oil can be prevented from being pooled on the upper face of the upper bearing. Accordingly, the expander-integrated compressor described above makes it possible to prevent heat transfer from the oil to the fluid in the expansion mechanism.

Furthermore, it is preferable that the bearing have a lower bearing that supports a portion of the lower rotating portion located below the cylinder, a through hole that penetrates integrally through the upper bearing, the cylinder, and the lower bearing be provided, and the return passage be configured by the through hole.

The expander-integrated compressor described above allows the oil that has flowed out to the upper face of the upper bearing to be returned to the oil reservoir with a simple configuration. Therefore, the oil can be prevented from being pooled on the upper face of the upper bearing. Accordingly, the expander-integrated compressor described above makes it possible to prevent heat transfer from the oil to the fluid in the expansion mechanism, with a simple configuration.

Furthermore, it is preferable that the expander-integrated compressor include a cover that integrally covers, above the upper face of the upper bearing, a space around the rotating shaft and a space above the through hole.

The expander-integrated compressor described above allows all of the oil that has flowed out to the upper face of the upper bearing from the first oil supply passage to be guided to the through hole. Therefore, all of the oil that has flowed out to the upper face of the upper bearing can be returned to the oil reservoir without being supplied to the groove portion. Furthermore, by covering a part of the upper face of the upper bearing with the cover, the oil that has flowed out from the first oil supply passage can be pooled in a part of the upper face. Accordingly, the heat of the oil further can be prevented from being transferred to the upper bearing. Therefore, this expander-integrated compressor makes it possible to supply a sufficient amount of the oil to the partition member of the expansion mechanism and to further prevent heat transfer from the oil to the fluid in the expansion mechanism.

Furthermore, it is preferable that the bearing have a lower bearing that supports a portion of the lower rotating portion located below the cylinder, a lower through hole that extends from the rear chamber to a bottom face of the lower bearing be formed in the lower bearing, and the upper through hole, the rear chamber, and the lower through hole configure a return passage that guides the oil located on the upper face of the upper bearing to the oil reservoir.

In the expander-integrated compressor described above, the upper through hole, the rear chamber, and the lower through hole configure the return passage that guides the oil that has flowed out to the upper face of the upper bearing from the first oil supply passage, to the oil reservoir. Therefore, the oil that has flowed out to the upper face of the upper bearing from the first oil supply passage is returned to the oil reservoir after lubricating and sealing the partition member. Accordingly, the expander-integrated compressor described above allows the oil to be supplied to the partition member and the oil that has flowed out to the upper face of the upper bearing to be returned to the oil reservoir, with a simple configuration.

Furthermore, it is preferable that the first oil supply passage be formed in the outer circumferential surface of the lower rotating portion or in the inner circumferential surface of the bearing and be configured by a groove that spirally extends from a lower side toward an upper side.

The expander-integrated compressor described above allows the oil to be supplied to each sliding part of the expansion mechanism, with a simple configuration.

Furthermore, it is preferable that a third oil supply passage that guides the oil drawn by the suction mechanism to the compression mechanism be formed inside the rotating shaft.

The expander-integrated compressor described above is provided with the third oil supply passage in addition to the first oil supply passage that supplies the oil contained in the oil reservoir to the expansion mechanism. The oil contained in the oil reservoir is supplied to the compression mechanism through the third oil supply passage. In this manner, when the expansion mechanism and the compression mechanism have separate oil supply passages, it is possible to supply the oil to the compression mechanism more reliably.

The oil supplied to the compression mechanism is heated by the compression mechanism while lubricating the sliding parts of the compression mechanism. The oil that has lubricated the sliding parts of the compression mechanism then is discharged from the compression mechanism and falls due to gravitational force to be returned to the oil reservoir located in the bottom portion of the closed casing. However, part of the oil may adhere to the upper face of the upper bearing while falling. Since this oil has a relatively high temperature, when the oil adheres to the upper face of the upper bearing, heat is transferred from the oil to the upper bearing and thereby the expansion mechanism is heated. Therefore, the present inventors made the following invention.

That is, it is preferable that the expander-integrated compressor further include an upper bearing that supports a portion of the lower rotating portion located above the cylinder, and an upper cover that is placed above the upper bearing inside the closed casing and that covers an upper side of at least a part of the upper bearing.

The expander-integrated compressor described above makes it possible to prevent the high temperature oil discharged from the compression mechanism from adhering to the upper face of the upper bearing by the upper cover. Therefore, the expansion mechanism can be prevented from being heated by the high temperature oil discharged from the compression mechanism. Accordingly, heat transfer from the compression mechanism to the expansion mechanism can be prevented.

Preferably, the upper cover includes a disk-shaped plate-like body fixed to the rotating shaft.

In this case, the upper cover rotates together with the rotating shaft. Therefore, the high temperature oil that has adhered to the upper face of the upper cover is scattered radially and outwardly due to centrifugal force produced by rotation of the upper cover. This oil then adheres to the inner wall of the closed casing due to its viscosity and then falls along the inner wall to the oil reservoir located in the bottom portion of the closed casing. This makes it possible to return the oil discharged from the compression mechanism to the oil reservoir quickly.

Furthermore, it is preferable that the upper cover be inclined downward toward the radially outer side of the rotating shaft.

This allows the oil discharged from the compression mechanism to be returned to the oil reservoir more quickly.

Furthermore, it is preferable that the expander-integrated compressor include a lower cover that separates the oil contained in the oil reservoir from the expansion mechanism. It is advantageous that the lower cover include a bottom plate located below the expansion mechanism and a side plate that rises upward or obliquely upward from the outer circumference portion of the bottom plate and that extends to a higher position than that of the lower end of the expansion mechanism.

In the expander-integrated compressor described above, even when the amount of the oil contained in the oil reservoir is increased and thereby the oil level reaches the vicinity of the lower end of the expansion mechanism, the lower cover can prevent the oil contained in the oil reservoir from being brought into contact with the expansion mechanism. Therefore, heat transfer from the oil contained in the oil reservoir to the expansion mechanism can be prevented. Thus, even when the oil level in the oil reservoir increases to some extent, the heat transfer from the oil contained in the oil reservoir to the expansion mechanism can be prevented.

Furthermore, the expander-integrated compressor according to the present invention can be employed suitably in a refrigeration cycle apparatus. That is, a refrigeration cycle apparatus according to the present invention includes an expander-integrated compressor, a first flow passage that guides the fluid compressed by a compression mechanism of the expander-integrated compressor, a radiator that allows the fluid guided by the first flow passage to release heat, a second flow passage that guides the fluid from the radiator to an expansion mechanism of the expander-integrated compressor, a third flow passage that guides the expanded fluid in the expansion mechanism, an evaporator that evaporates the fluid guided by the third flow passage, and a fourth flow passage that guides the fluid from the evaporator to the compression mechanism.

Accordingly, a refrigeration cycle apparatus can be obtained that has a high refrigeration capacity and can prevent operational instability caused by the shortage of the lubricating oil.

Hereinafter, embodiments of the present invention are described in detail with reference to the drawings.

First Embodiment

As shown in FIG. 1, an expander-integrated compressor 5A according to this embodiment is incorporated in a refrigerant circuit 1 of a refrigeration cycle apparatus. The expander-integrated compressor 5A includes a compression mechanism 21 for compressing the refrigerant and an expansion mechanism 22 for expanding the refrigerant. The compression mechanism 21 is connected to an evaporator 3 through an intake pipe 6 and also is connected to a radiator 2 through a discharge pipe 7. The expansion mechanism 22 is connected to the radiator 2 through an intake pipe 8 and also is connected to the evaporator 3 through a discharge pipe 9. Reference numeral 4 indicates an expansion valve provided for a subcircuit 11, and reference numeral 23 a motor to be described later.

This refrigerant circuit 1 is filled with a refrigerant such that it reaches a supercritical state in the high-pressure portion (i.e. the portion extending from the compression mechanism 21 to the expansion mechanism 22 through the radiator 2). In this embodiment, carbon dioxide ($CO_2$) is used as such a refrigerant. However, the type of the refrigerant is not particularly limited. The refrigerant in the refrigerant circuit 1 may be a refrigerant that does not reach a supercritical state during operation (for example, fluorocarbon-based refrigerants).

The refrigerant circuit in which the expander-integrated compressor 5A is incorporated is not limited to the refrigerant circuit 1 in which the refrigerant flows in only one direction. The expander-integrated compressor 5A may be provided in a refrigerant circuit in which the flow direction of the refrigerant may be changed. For example, the expander-integrated compressor 5A may be provided in a refrigerant circuit that has, for example, a four-way valve and is thereby capable of performing a heating operation and a cooling operation.

Figure 2:
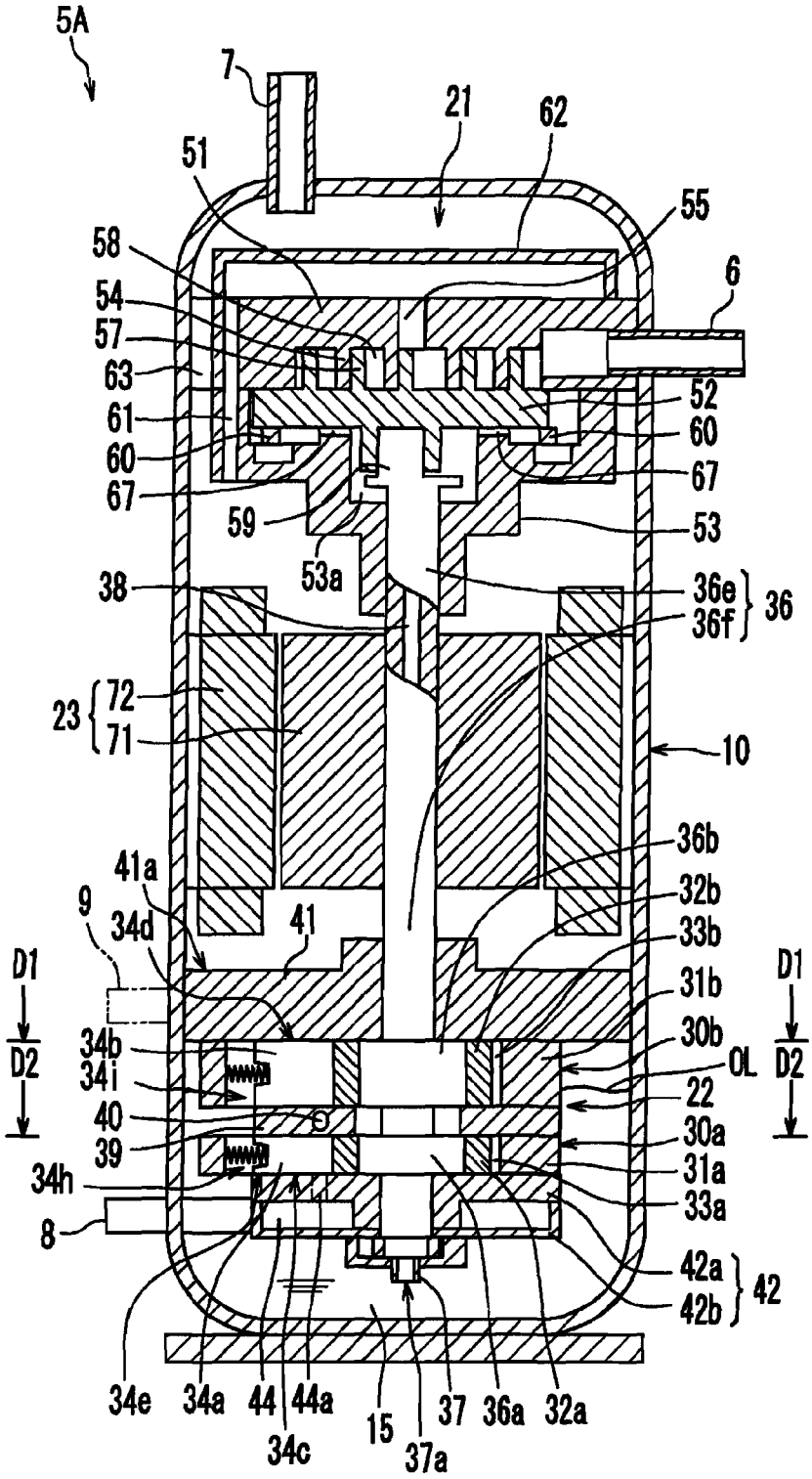
FIG. 2 is a vertical cross-sectional view of the expander-integrated compressor according to the first embodiment of the present invention.

As shown in FIG. 2, the compression mechanism 21 and the expansion mechanism 22 of the expander-integrated compressor 5A are accommodated inside a closed casing 10. The expansion mechanism 22 is disposed below the compression mechanism 21, and the motor 23 is provided between the compression mechanism 21 and the expansion mechanism 22. An oil reservoir 15 for holding oil is formed in a bottom portion inside the closed casing 10. Generally, the oil is placed in the oil reservoir 15 in such a manner that the oil level OL is located above a lower end portion 34*e* of a vane 34*a* of a first expansion section 30*a* to be described later. More preferably, the oil is placed in such a manner that the expansion mechanism 22 is immersed in the oil.

First, the configuration of the expansion mechanism 22 will be described. The expansion mechanism 22 includes an upper bearing 41, the first expansion section 30*a*, a second expansion section 30*b*, and a lower bearing 42. The first expansion section 30*a* is disposed below the second expansion section 30*b*. The upper bearing 41 is disposed above the second expansion section 30*b* and the lower bearing 42 is disposed below the first expansion section 30*a*.

Figure 3A:
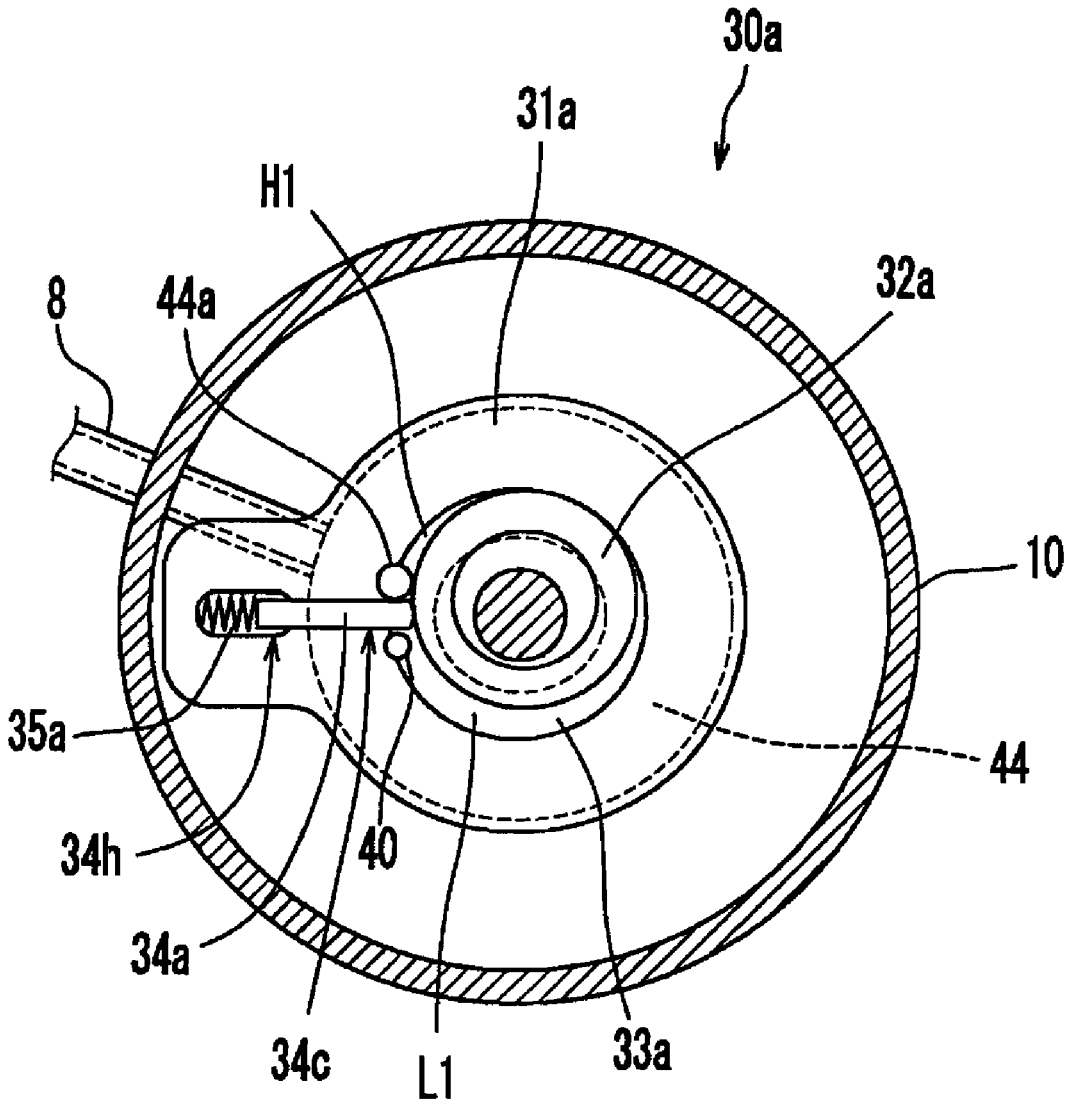
FIG. 3A is a cross-sectional view taken on line D2-D2 of FIG. 2.

FIG. 3A is a cross-sectional view taken on line D2-D2 of FIG. 2. As shown in FIG. 3A, the first expansion section 30*a* is a rotary expansion mechanism and has a substantially cylindrically shaped cylinder 31*a* and a cylindrically shaped piston 32*a* inserted inside the cylinder 31*a*. A first fluid chamber 33*a* is defined between the inner circumferential surface of the cylinder 31*a* and the outer circumferential surface of the piston 32*a*. A radially and outwardly extending vane groove 34*c* is formed in the cylinder 31*a*, and the vane 34*a* is inserted slidably in the vane groove 34*c*. Furthermore, a rear chamber 34*h* that communicates with the vane groove 34*c* and extends radially and outwardly is formed in the cylinder 31*a* on the rear side (radially outer side) of the vane 34*a*. The rear chamber 34*h* is provided with a spring 35*a* for biasing the vane 34*a* toward the piston 32*a*. The vane 34*a* partitions the first fluid chamber 33*a* into a high-pressure side fluid chamber H1 and a low-pressure side fluid chamber L1.

Figure 3B:
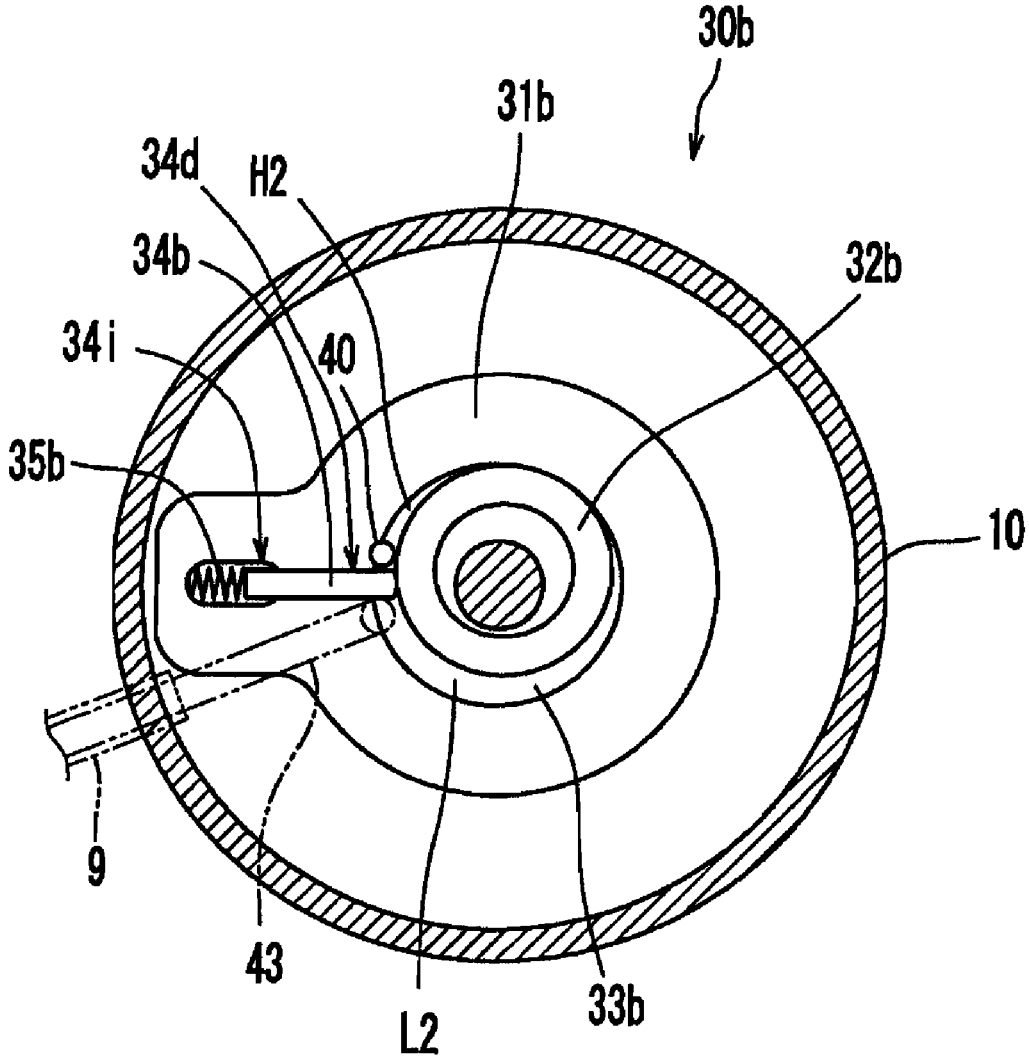
FIG. 3B is a cross-sectional view taken on line D1-D1 of FIG. 2.

FIG. 3B is a cross-sectional view taken on line D1-D1 of FIG. 2. As shown in FIG. 3B, the second expansion section 30*b* has substantially the same configuration as that of the first expansion section 30*a*. That is, the second expansion section 30*b* also is a rotary expansion mechanism and has a substantially cylindrically shaped cylinder 31*b* and a cylindrically shaped piston 32*b* inserted inside the cylinder 31*b*. A second fluid chamber 33*b* is defined between the inner circumferential surface of the cylinder 31*b* and the outer circumferential surface of the piston 32*b*. Similarly in the cylinder 31*b*, a radially and outwardly extending vane groove 34*d* is formed, and a vane 34*b* is inserted slidably in the vane groove 34*d*. Furthermore, a rear chamber 34*i* that communicates with the vane groove 34*d* and extends radially and outwardly is formed in the cylinder 31*b* on the rear side of the vane 34*b*. The rear chamber 34*i* is provided with a spring 35*b* for biasing the vane 34*b* toward the piston 32*b*. The vane 34*b* partitions the second fluid chamber 33*b* into a high-pressure side fluid chamber H2 and a low-pressure side fluid chamber L2. The sizes (inner diameter, outer diameter, and height) of the cylinder 31*b* and the piston 32*b* of the second expansion section 30*b* are determined so that the volumetric capacity of the second fluid chamber 33*b* is larger than that of the first fluid chamber 33*a* of the first expansion section 30*a*.

As shown in FIG. 2, the expansion mechanism 22 shares a vertically extending rotating shaft 36 with the compression mechanism 21. The rotating shaft 36 has an upper rotating portion 36*e* for rotating the compression mechanism 21 and a lower rotating portion 36*f* subjected to a torque by the expansion mechanism 22. Furthermore, the lower rotating portion 36*f* has a first eccentric portion 36*a* and a second eccentric portion 36*b*. The first eccentric portion 36*a* is inserted slidably inside the piston 32*a*, and the second eccentric portion 36*b* is inserted slidably inside the piston 32*b*. Thereby, the piston 32*a* is regulated to revolve within the cylinder 31*a* in an off-centered state by the first eccentric portion 36*a*. Likewise, the piston 32*b* is regulated to revolve within the cylinder 31*b* in an off-centered state by the second eccentric portion 36*b*.

Moreover, the upper rotating portion 36*e* and the lower rotating portion 36*f* may be formed of two components coupled to each other so that mechanical power recovered in the expansion mechanism 22 can be transmitted to the compression mechanism 21.

The first expansion section 30*a* and the second expansion section 30*b* are partitioned with a partition plate 39. The partition plate 39 covers the upper sides of the cylinder 31*a* and the piston 32*a* of the first expansion section 30*a* and defines the upper side of the first fluid chamber 33*a*. Furthermore, the partition plate 39 covers the lower sides of the cylinder 31*b* and the piston 32*b* of the second expansion section 30*b* and defines the lower side of the second fluid chamber 33*b*. The upper side of the vane groove 34*c* and the lower side of the vane groove 34*d* are closed with the partition plate 39, but the upper side of the rear chamber 34*h* and the lower side of the rear chamber 34*i* are not closed with the partition plate 39 but open.

A communication hole 40 for allowing the low-pressure side fluid chamber L1 (see FIG. 3A) of the first fluid chamber 33*a* to communicate with the high-pressure side fluid chamber H2 (see FIG. 3B) of the second fluid chamber 33*b* is formed in the partition plate 39. In this embodiment, the low-pressure side fluid chamber L1 of the first fluid chamber 33*a* and the high-pressure side fluid chamber H2 of the second fluid chamber 33*b* form one expansion chamber through the communication hole 40. In other words, the refrigerant expands inside one space formed by the low-pressure side fluid chamber L1 of the first fluid chamber 33*a*, the communication hole 40, and the high-pressure side fluid chamber H2 of the second fluid chamber 33*b*.

The lower bearing 42 is provided below the first expansion section 30*a*. The lower bearing 42 includes an upper member 42*a* and a lower member 42*b* axially adjacent to each other, and the upper member 42*a* supports the lower end of the rotating shaft 36. The upper member 42*a* closes the bottoms of the cylinder 31*a* and the piston 32*a* of the first expansion section 30*a* and defines the lower side of the first expansion chamber 33*a*. On the other hand, the lower member 42*b* closes the bottom of the upper member 42*a* and defines the lower side of an intake passage 44 to be described later. The lower side of the rear chamber 34*h* is not closed by the upper member 42*a* and the lower member 42*b* but open.

In the lower bearing 42, the intake passage 44 that guides the refrigerant from the intake pipe 8 to the first fluid chamber 33*a* is formed by the upper member 42*a* and the lower member 42*b*. Furthermore, in the upper member 42*a*, an intake port 44*a* is formed that allows the fluid chamber 33*a* and the intake passage 44 to communicate with each other. The intake pipe 8 penetrates through a side part of the closed casing 10 and is connected to the lower bearing 42. The intake pipe 8 communicates with the intake passage 44 (see FIG. 3A). Furthermore, the intake pipe 8 is disposed below the bottom end 34*e* of the vane 34*a*.

The upper bearing 41 is provided above the second expansion section 30*b*. The upper bearing 41 closes the upper sides of the cylinder 31*b* and the piston 32*b* of the second expansion section 30*b* and defines the upper side of the second fluid chamber 33*b*. In the upper bearing 41, a discharge passage 43 (see FIG. 3B) is formed that guides the refrigerant from the second fluid chamber 33*b* to the discharge pipe 9. The discharge pipe 9 penetrates through a side part of the closed casing 10 and is connected to the upper bearing 41.

The lower end of the rotating shaft 36 is immersed in the oil contained in the oil reservoir 15. The lower end of the rotating shaft 36 is provided with an oil pump 37 for pumping the oil up. A suction port 37*a* of the oil pump 37 is formed in a lower position than that of the bottom end 34*e* of the vane 34*a* of the expansion mechanism 22. Furthermore, an axially and linearly extending oil supply passage 38 is formed inside the rotating shaft 36.

The upper bearing 41 is joined to the inner wall of the closed casing 10 by, for example, welding. The cylinder 31*b*, the partition plate 39, the cylinder 31*a*, and the lower bearing 42 are fastened to the upper bearing 41 with bolts (not shown). As a result, the cylinder 31*b*, the partition plate 39, the cylinder 31*a*, and the lower bearing 42 are fixed to the closed casing 10.

Next, the configuration of the compression mechanism 21 will be described. The compression mechanism 21 is a scroll-type compression mechanism. The compression mechanism 21 is joined to the closed casing 10 by, for example, welding. The compression mechanism 21 includes a stationary scroll 51, a movable scroll 52 axially opposing the stationary scroll 51, and a bearing 53 for supporting the upper rotating portion 36*e* of the rotating shaft 36.

A lap 54 in a scroll shape (such as an involute shape) is formed in the stationary scroll 51. A lap 57 that engages with the lap 54 of the stationary scroll 51 is formed in the movable scroll 52. A scroll compression chamber 58 is defined between the lap 54 and the lap 57. A discharge port 55 is provided in the center portion of the stationary scroll 51. An Oldham ring 60 for preventing rotation of the movable scroll 52 is disposed below the movable scroll 52. An eccentric portion 59 is formed at the upper end of the rotating shaft 36, and the movable scroll 52 is supported on the eccentric portion 59. As a result, the movable scroll 52 revolves in an off-centered state from the shaft center of the rotating shaft 36. An oil supply port 67 is formed in the bearing 53.

A cover 62 is provided above the stationary scroll 51. A vertically extending discharge passage 61 for carrying the refrigerant is formed inside the stationary scroll 51 and the bearing 53. A vertically extending flow passage 63 for carrying the refrigerant is formed outside the stationary scroll 51 and the bearing 53. With such a configuration, the refrigerant discharged from the discharge port 55 is discharged into the space within the cover 62 temporarily and then is discharged to the lower side of the compression mechanism 21 through the discharge passage 61. Thereafter, the refrigerant located below the compression mechanism 21 is guided to the upper side of the compression mechanism 21 through the flow passage 63.

The intake pipe 6 penetrates through a side part of the closed casing 10 and is connected to the stationary scroll 51. Therefore, the intake pipe 6 is connected to the suction side of the compression mechanism 21. The discharge pipe 7 is connected to the top part of the closed casing 10. One end of the discharge pipe 7 opens toward the space located above the compression mechanism 21 inside the closed casing 10.

The motor 23 is configured with a rotor 71 that is fixed to a mid portion of the rotating shaft 36, and a stator 72 disposed at the outer circumferential side of the rotor 71. The stator 72 is fixed to the inner wall of a side part of the closed casing 10. The stator 72 is connected to a terminal (not shown) through a motor wire (not shown). This motor 23 drives the rotating shaft 36.

Next, the operation of the expander-integrated compressor 5A will be described. In this expander-integrated compressor 5A, the rotating shaft 36 rotates when the motor 23 is driven.

In the compression mechanism 21, the movable scroll 52 revolves in association with rotation of the rotating shaft 36 and thereby the refrigerant is drawn in through the intake pipe 6. The low pressure refrigerant that has been drawn in is compressed in the compression chamber 58 to become a high pressure refrigerant, and thereafter is discharged through the discharge port 55. The refrigerant discharged through the discharge port 55 is guided above the compression mechanism 21 through the discharge passage 61 and the flow passage 63 and then is discharged through the discharge pipe 7 to the outside of the closed casing 10.

In the expansion mechanism 22, the pistons 32*a* and 32*b* revolve in association with rotation of the rotating shaft 36. Therefore, the high pressure refrigerant that has been drawn into the intake port 44*a* from the intake pipe 8 flows into the first fluid chamber 33*a* through the intake port 44*a*. The high pressure refrigerant that has flowed into the first fluid chamber 33*a* is expanded inside a space that is formed by the low-pressure side fluid chamber L1 of the first fluid chamber 33*a*, the communication hole 40, and the high-pressure side fluid chamber H2 of the second fluid chamber 33*b* to be turned into a low pressure refrigerant. This low pressure refrigerant flows into the discharge pipe 9 through the discharge passage 43 (see FIG. 3B) and is discharged to the outside of the closed casing 10 through the discharge pipe 9.

Next, an oil supply operation will be described. First, an oil supply operation to the compression mechanism 21 is described.

In association with rotation of the rotating shaft 36, the oil contained in the oil reservoir 15 is pumped up by the oil pump 37 and rises inside the oil supply passage 38 of the rotating shaft 36 to the compression mechanism 21. The oil then is supplied to an inner space 53*a* of the bearing 53. The oil supplied inside the inner space 53*a* is supplied to sliding parts of the compression mechanism 21 through the oil supply port 67. This oil then lubricates and seals the sliding parts of the compression mechanism 21. After lubricating and sealing, the oil is discharged from the lower end of the bearing 53 to the inside of the closed casing 10 and then is returned to the oil reservoir 15 through the gaps (for example, the gap between the rotor 71 and the stator 72 and the gap between the stator 72 and the closed casing 10) in the motor 23.

Part of the oil supplied to the sliding parts of the compression mechanism 21 flows into the compression chamber 58 and is mixed with the refrigerant. Therefore, the oil mixed with the refrigerant is discharged together with the refrigerant to the inside of the closed casing 10 through the discharge port 55 and the discharge passage 61. Part of the oil thus discharged is separated from the refrigerant by, for example, gravitational force or centrifugal force. Thereafter, the oil is returned to the oil reservoir 15 through the gaps in the motor 23. On the other hand, the oil that has not been separated from the refrigerant is guided above the compression mechanism 21 together with the refrigerant and is discharged to the outside of the closed casing 10 through the discharge pipe 7.

Next, an oil supply operation to the expansion mechanism 22 will be described.

As described above, the oil is placed in the oil reservoir 15 in such a manner that the oil level OL is located above the lower end portion 34*e* of the vane 34*a*, more preferably, the expansion mechanism 22 is immersed in the oil. Therefore, the first expansion section 30*a* or both the first expansion section 30*a* and the second expansion section 30*b* are immersed in the oil. Furthermore, the upper side and the lower side of the rear chamber 34*h* of the first expansion section 30*a* are open and the lower side of the rear chamber 34*i* of the second expansion section 30*b* also is open. Accordingly, the oil contained in the oil reservoir 15 enters the vane groove 34*c* and the vane groove 34*d* or the insides of the first expansion section 30*a* and the second expansion section 30*b* from the above-mentioned openings and then is supplied to each sliding part. This oil then lubricates and seals the sliding parts of the expansion mechanism 22.

As described above, in the expander-integrated compressor 5A according to this embodiment, the compression mechanism 21 is provided above the expansion mechanism 22, and the oil contained in the oil reservoir 15 is supplied to the compression mechanism 21 through the oil supply passage 38 by the oil pump 37. On the other hand, the oil reservoir 15 holds the oil in such a manner that the oil level OL is higher than the bottom end 34*e* of the vane 34*a*, and thereby the oil is supplied directly from the oil reservoir 15 to the vanes 34*a* and 34*b* of the expansion mechanism 22. Therefore, when the oil level OL of the oil reservoir 15 is lowered and reaches a level below the bottom end 34*e* of the vane 34*a*, the oil is prevented from being supplied to the vanes 34*a* and 34*b* of the expansion mechanism 22 first. This prevents the oil level OL in the oil reservoir 15 from lowering. On the other hand, since the suction port 37*a* of the oil pump 37 is formed in a lower position than that of the bottom end 34*e* of the vane 34*a* of the expansion mechanism 22, the oil continues being supplied to the compression mechanism 21. Therefore, the oil can be supplied stably to the compression mechanism 21. Accordingly, this expander-integrated compressor 5A makes it possible to supply the oil to the compression mechanism 21 in preference to the expansion mechanism 22 and to prevent operational instability caused by the shortage of the lubricating oil in the compression mechanism 21. Furthermore, it also is possible to prevent the performance of the refrigeration cycle, in which the compression mechanism 21 is used as a power source, from being deteriorated, by stabilizing the operation of the compression mechanism 21.

Furthermore, this expander-integrated compressor 5A allows the oil to be supplied to the vanes 34*a* and 34*b* reliably by holding the oil in the oil reservoir 15 to such a degree that the expansion mechanism 22 is immersed in the oil. Thus, the expansion efficiency of the expansion mechanism 22 can be prevented from deteriorating by an easy operation.

In this expander-integrated compressor 5A, the oil supplied to the compression mechanism 21 is returned to the oil reservoir 15 after lubricating the sliding parts of the compression mechanism 21. Alternatively, after being discharged into the closed casing 10 together with the discharge refrigerant, the oil is separated from the refrigerant inside the closed casing 10 and then is returned to the oil reservoir 15. Therefore, the temperature of the oil contained in the oil reservoir 15 becomes relatively high. On the other hand, the refrigerant with a relatively low temperature is supplied to the expansion mechanism 22.

In this expander-integrated compressor 5A, the intake pipe 8 is disposed below the bottom end 34*e* of the vane 34*a*. Furthermore, the oil is held in the oil reservoir 15 in such a manner that the oil level OL is higher than the bottom end 34*e* of the vane 34*a*. This allows the intake pipe 8 to be immersed in the oil contained in the oil reservoir 15. Therefore, heat is transferred from the high temperature oil contained in the oil reservoir 15 to the low temperature refrigerant inside the intake pipe 8 and thereby the refrigerant to be drawn into the expansion mechanism 22 is heated. Accordingly, with this expander-integrated compressor 5A, the enthalpy of the refrigerant to be drawn into the expansion mechanism 22 increases and thereby the recovery power of the expansion mechanism 22 increases.

In this expander-integrated compressor 5A, the discharge pipe 9 is connected to the upper bearing 41 and is disposed above the oil level OL in the oil reservoir 15. Therefore, it is possible to prevent heat transfer from the oil contained in the oil reservoir 15 to the refrigerant in the discharge pipe 9 (refrigerant discharged from the expansion mechanism 22). Accordingly, this expander-integrated compressor 5A makes it possible to reduce the decrease in heat absorption ability in the evaporator 3 built into the refrigeration cycle apparatus and thereby to improve the refrigeration performance of the refrigeration cycle apparatus.

In this expander-integrated compressor 5A, a scroll compressor is used as the compression mechanism 21. The scroll compressor does not have a partition member like the one provided in a rotary compressor. Accordingly, with this expander-integrated compressor 5A, the problem of a shortage in oil supply to the partition member of the compression mechanism 21 does not arise and therefore the operation of the compression mechanism 21 can be stabilized.

From the viewpoint of preventing heat transfer from the oil to the refrigerant, it is desirable that the discharge pipe 9, through which the expanded refrigerant is discharged, be disposed in a location away from the oil reservoir 15. Furthermore, from the viewpoints of preventing heat transfer and suppressing pressure loss, it is preferable that the refrigerant expansion passage (overall length of the flow passage) inside the expansion mechanism 22 be shorter.

In this expander-integrated compressor 5A, the discharge pipe 9 is connected to the upper bearing 41. This makes it possible to dispose the discharge pipe 9 in a location away from the oil reservoir 15. Furthermore, with this expander-integrated compressor 5, since the second expansion section 30*b*, to which the discharge pipe 9 is connected, is disposed on the upper side, it is not necessary to provide a bypass needlessly for keeping the discharge pipe 9 away from the oil reservoir 15 and thereby the expansion passage can be shortened. Accordingly, heat transfer from the oil contained in the oil reservoir 15 to the discharge refrigerant of the expansion mechanism 22 can be prevented and the pressure loss of the refrigerant can be suppressed.

Furthermore, in this expander-integrated compressor 5A, the discharge pipe 9 is connected to the upper bearing 41. Therefore, even when the oil level OL in the oil reservoir 15 is set to be below the discharge pipe 9, the oil can be supplied sufficiently to the vanes 34*a* and 34*b*. This makes it possible simultaneously to carry out oil supply to the vanes 34*a* and 34*b* and prevention of heat transfer from the oil contained in the oil reservoir 15 to the refrigerant in the discharge pipe 9 (refrigerant discharged from the expansion mechanism 22). Accordingly, the use of this expander-integrated compressor 5A makes it possible to reduce the decrease in heat absorption ability in the evaporator 3 built into the refrigeration cycle apparatus. Thus, refrigeration performance of the refrigeration cycle apparatus can be improved.

In this embodiment, carbon dioxide was used as the refrigerant. Generally, oil blends into carbon dioxide in a supercritical state relatively easily. Therefore, in the expander-integrated compressor using carbon dioxide as a refrigerant, oil shortage tends to occur inherently. However, as described above, this expander-integrated compressor 5A makes it possible to supply the oil reliably to the compression mechanism 21 and thereby prevent oil shortage effectively. Accordingly, even when carbon dioxide is used as a working fluid, operational instability caused by the shortage of the lubricating oil in the compression mechanism 21 can be prevented. Furthermore, it also is possible to prevent a deterioration in performance of the refrigeration cycle that uses the compression mechanism 21 as a power source, by stabilizing operation of the compression mechanism 21.

In this embodiment, the vanes 34*a* and 34*b* were formed separately from the pistons 32*a* and 32*b*, respectively. However, bushings that sandwich the vanes 34*a* and 34*b* and move inside the vane grooves 34*c* and 34*d* may be provided instead of the springs 35*a* and 35*b*, and the vanes 34*a* and 34*b* may be formed integrally with the pistons 32*a* and 32*b*, respectively. That is, the rotary expansion mechanism referred to in this specification includes not only a rolling piston type expansion mechanism but also a so-called swing type expansion mechanism.

Second Embodiment

In the first embodiment, a part or the whole of the expansion mechanism 22 is immersed in the oil contained in the oil reservoir 15, and the oil is supplied from the oil reservoir 15 directly to the vanes 34*a* and 34*b*. An expander-integrated compressor 5B according to this embodiment not only supplies the oil directly from the oil reservoir 15 but also supplies the oil reliably to the vanes 34*a* and 34*b* through provision of an oil supply passage for supplying the oil to the vanes 34*a* and 34*b* from the rotating shaft 36 side even when the oil level OL has been lowered.

Figure 4:
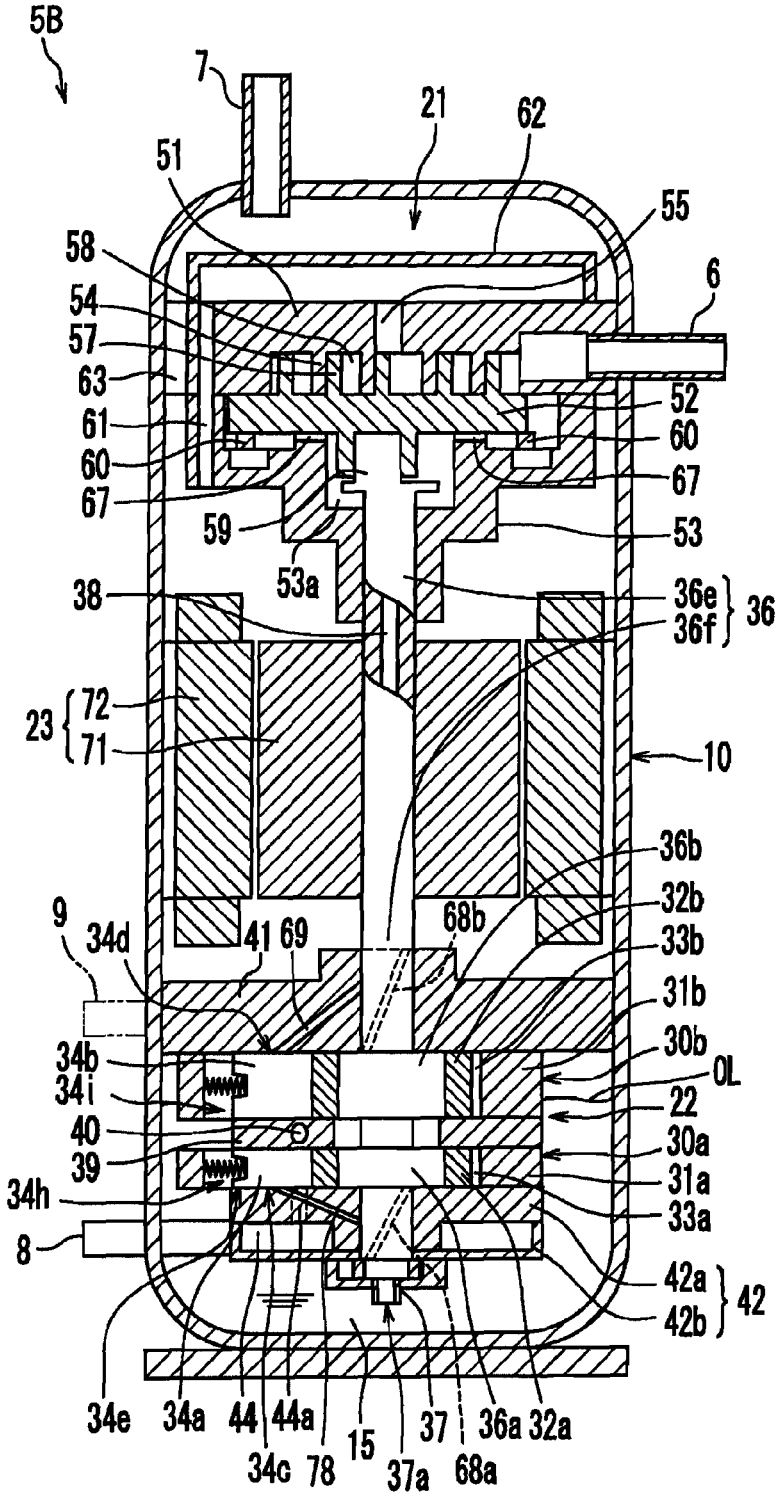
FIG. 4 is a vertical cross-sectional view of an expander-integrated compressor according to a second embodiment.

As shown in FIG. 4, the expander-integrated compressor 5B according to this embodiment has substantially the same configuration as that of the expander-integrated compressor 5A according to the first embodiment. Therefore, only the parts that are different will be described.

An axially and spirally extending oil supply groove 68*a* is formed in the inner circumferential surface of the lower bearing 42 of the expander-integrated compressor 5B according to this embodiment. Furthermore, an axially and spirally extending oil supply groove 68*b* is formed in the inner circumferential surface of the upper bearing 41. The oil supply groove 68*a* may be formed in the outer circumferential surface of a portion of the rotating shaft 36 that is supported by the lower bearing 42. Furthermore, the oil supply groove 68*b* also may be formed in the outer circumferential surface of a portion of the rotating shaft 36 that is supported by the upper bearing 41.

An upper communication hole 69 that extends from the oil supply groove 68*b* to the vane groove 34*d* is formed inside the upper bearing 41. Furthermore, a lower communication hole 78 that extends from the oil supply groove 68*a* to the vane groove 34*c* is formed inside the upper member 42*a* of the lower bearing 42.

With the configuration described above, in the expander-integrated compressor 5B according to this embodiment, the oil contained in the oil reservoir 15 is pumped up inside the oil supply passage 38 by the oil pump 37 and also is pumped up to the oil supply groove 68*a*, in association with rotation of the rotating shaft 36. Thus, the oil pumped up to the oil supply groove 68*a* rises through the oil supply groove 68*a* while lubricating a sliding part between the upper member 42*a* of the lower bearing 42 and the rotating shaft 36. Subsequently, the oil is supplied to sliding parts of the first eccentric portion 36*a* and the second eccentric portion 36*b* of the rotating shaft 36 as well as the piston 32*a* and the piston 32*b* and thereby each sliding part is lubricated and sealed. Furthermore, part of the oil that flows in the oil supply groove 68*a* is guided to the vane groove 34*c* through the lower communication hole 78. The oil guided to the vane groove 34*c* lubricates and seals the vane 34*a*.

The oil that has lubricated the sliding parts of the first eccentric portion 36*a* and the second eccentric portion 36*b* of the rotating shaft 36 as well as the piston 32*a* and the piston 32*b* then is guided to the oil supply groove 68*b* and then rises while lubricating the sliding part between the upper bearing 41 and the rotating shaft 36. In this case, part of the oil that flows through the oil supply groove 68*b* flows into the upper communication hole 69 to be guided to the vane groove 34*d*. The oil guided to the vane groove 34*d* lubricates and seals the vane 34*b*.

As described above, the expander-integrated compressor 5B according to this embodiment can supply the oil to the vane 34*a* through the oil supply groove 68*a* and the lower communication hole 78 and can supply the oil to the vane 34*b* through the oil supply groove 68*b* and the upper communication hole 69. Furthermore, the oil pump 37 that pumps the oil up to the oil supply groove 68*a* is attached to the lower end of the rotating shaft 36, and the suction port 37*a* of the oil pump 37 is formed in a lower position than that of the bottom end 34*e* of the vane 34*a* of the expansion mechanism 22. Therefore, even when the oil level OL in the oil reservoir 15 is lowered and the expansion mechanism 22 no longer is immersed in the oil, the oil can be supplied reliably to the vanes 34*a* and 34*b*. Accordingly, this expander-integrated compressor 5B can supply the oil reliably to the compression mechanism 21 and also can supply the oil reliably to the expansion mechanism 22. This makes it possible to prevent operational instability caused by the shortage of the lubricating oil in the compression mechanism 21 and to prevent expanding performance of the expansion mechanism 22 from deteriorating.

Third Embodiment

Figure 5:
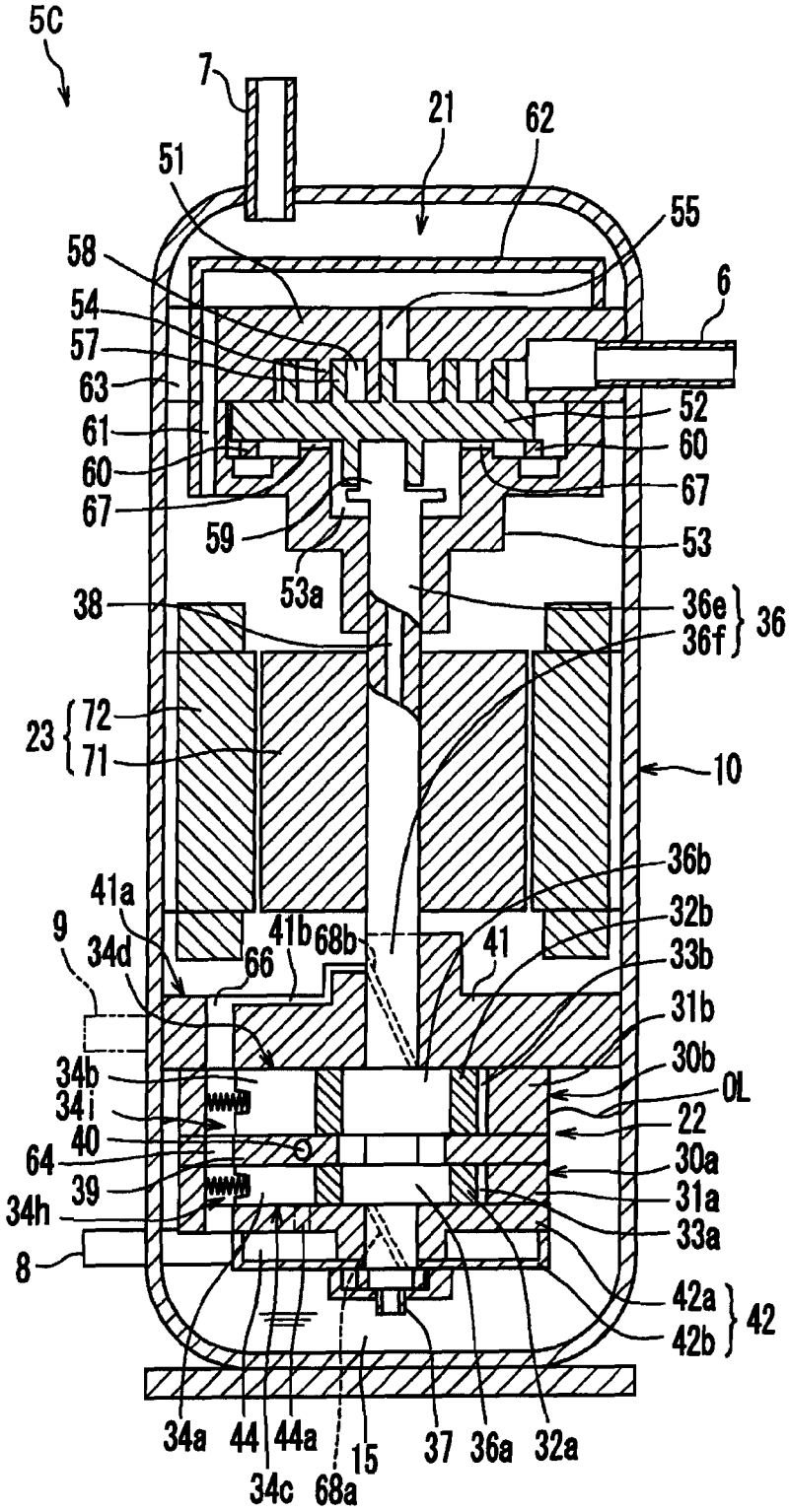
FIG. 5 is a vertical cross-sectional view of an expander-integrated compressor according to a third embodiment.

As shown in FIG. 5, an expander-integrated compressor 5C according to this embodiment also has substantially the same configuration as that of the expander-integrated compressor 5A according to the first embodiment. Therefore, only the parts that are different will be described.

This expander-integrated compressor 5C is provided with the oil supply grooves 68*a* and 68*b* as in the second embodiment. In addition, an upper through hole 66 that penetrates through the upper bearing 41 from its upper face 41*a* to its bottom face is provided in a portion of the upper bearing 41 located on the rear chamber 34*i*. Furthermore, the cross-sectional shape of the partition plate 39 is formed to be the same as (to coincide with) that of cylinders 31*a* and 31*b*, and a communication hole 64 that allows the rear chamber 34*h* and the rear chamber 34*i* to communicate with each other is formed in the partition plate 39.

With such a configuration, similarly in this expander-integrated compressor 5C, the oil contained in the oil reservoir 15 is pumped up to the oil supply groove 68*a* and rises while lubricating and sealing each sliding part, in association with rotation of the rotating shaft 36. The oil that is then guided by the oil supply groove 68*b* to reach the top end portion of the oil supply groove 68*b* flows out to the upper face 41*a* of the upper bearing 41. Thereafter, the oil that has flowed out to the upper face 41*a* of the upper bearing 41 flows on the upper face 41*a* to flow into the rear chamber 34*i* of the cylinder 31*b* from the upper through hole 66. Subsequently, the oil falls inside the space formed by the rear chamber 34*i*, the communication hole 64, and the rear chamber 34*h*. In this case, part of the oil is drawn into the vane groove 34*d* and the vane groove 34*c* due to the pressure difference between the insides and the outsides of the fluid chambers 33*b* and 33*a* and then lubricates and seals the gap between the vane 34*b* and the vane groove 34*d* as well as the gap between the vane 34*a* and the vane groove 34*c*.

As described above, the expander-integrated compressor 5C according to this embodiment also can supply the oil to the vanes 34*a* and 34*b* through the oil supply grooves 68*a* and 68*b*, the upper face 41*a* of the upper bearing 41, and the upper through hole 66. Therefore, similarly in this expander-integrated compressor 5C, when the oil level OL in the oil reservoir 15 has been lowered, the oil can be supplied reliably to the compression mechanism 21 and also can be supplied reliably to the expansion mechanism 22.

As shown in FIG. 5, an oil supply groove 41*b* that connects the oil supply groove 68*b* and the upper through hole 66 may be formed in the upper face 41*a* of the upper bearing 41. Furthermore, the upper face 41*a* of the upper bearing 41 may be formed to be inclined downwardly from the rotating shaft 36 side toward the upper through hole 66. Formation of the upper bearing 41 in this form allows the oil that has flowed out to the upper face 41*a* of the upper bearing 41 from the oil supply groove 68*b* to flow into the upper through hole 66 easily. Therefore, such an expander-integrated compressor 5C allows the oil to be supplied to the vanes 34*a* and 34*b* further reliably.

Furthermore, in FIG. 5, the lower side of the rear chamber 34*h* is generally open. However, the lower side of the rear chamber 34*h* may be closed with the lower bearing 42 and a through hole with a smaller diameter than that of the opening shown in FIG. 5 may be provided in the lower bearing 42. With this configuration, the oil that has flowed into the rear chamber 34*i* is held temporarily inside the space formed by the rear chamber 34*i*, the communication hole 64, and the rear chamber 34*h*, and the oil is drawn into the vanes 34*a* and 34*b* sides more easily. Therefore, the oil can be supplied to the vanes 34*a* and 34*b* more reliably. Furthermore, similarly, the same advantageous effects can be obtained even when the diameter of the communication hole 64 is reduced.

Fourth Embodiment

In the first embodiment, the second expansion section 30*b* was provided above the first expansion section 30*a*. In an expander-integrated compressor 5D according to this embodiment, the second expansion section 30*b* is provided below the first expansion section 30*a*. Since basic configurations of the first expansion section 30*a* and the second expansion section 30*b* are same as those in the first embodiment, descriptions thereof are not repeated. Hereinafter, only the parts that are different will be described.

Figure 6:
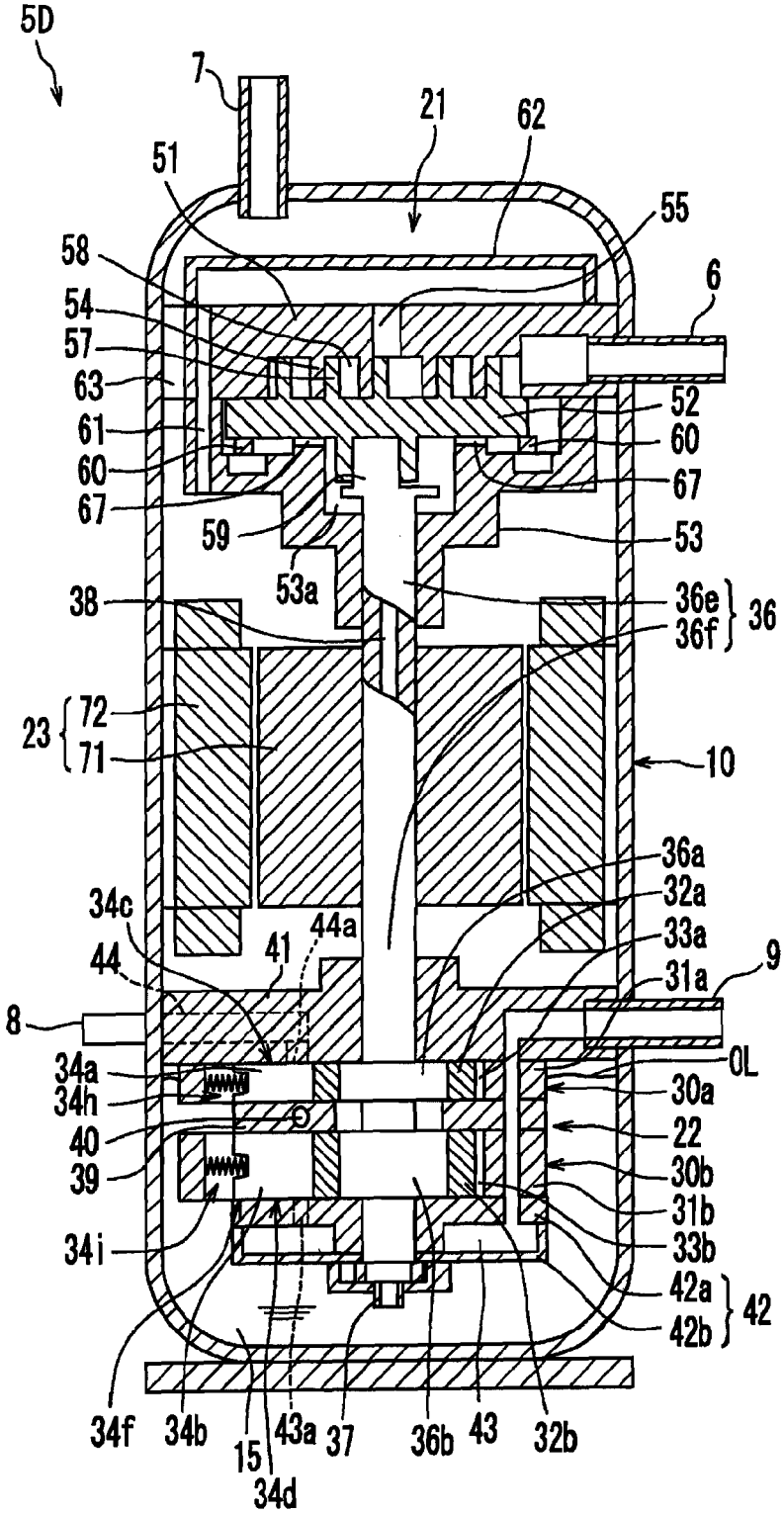
FIG. 6 is a vertical cross-sectional view of an expander-integrated compressor according to a fourth embodiment.

As shown in FIG. 6, in this expander-integrated compressor 5D, the second expansion section 30*b* is provided below the first expansion section 30*a*. Furthermore, the oil is placed in the oil reservoir 15 in such a manner that the oil level OL is located above a lower end portion 34*f* of the vane 34*b*, more preferably the expansion mechanism 22 is immersed in the oil.

The first expansion section 30*a* and the second expansion section 30*b* are partitioned by the partition plate 39. The partition plate 39 covers the lower sides of the cylinder 31*a* and the piston 32*a* of the first expansion section 30*a* and defines the lower side of the first fluid chamber 33*a*. Furthermore, the partition plate 39 covers the upper sides of the cylinder 31*b* and the piston 32*b* in the second expansion section 30*b* and defines the upper side of the second fluid chamber 33*b*. The lower side of the rear chamber 34*h* and the upper side of the rear chamber 34*i* are not closed by the partition plate 39 but open. Moreover, the communication hole 40 is formed in the partition plate 39 as in the first embodiment.

The lower bearing 42 is provided below the second expansion section 30*b*. The lower bearing 42 includes the upper member 42*a* and the lower member 42*b* axially adjacent to each other. The upper member 42*a* closes the lower sides of the cylinder 31*b* and the piston 32*b* in the second expansion section 30*b* and defines the lower side of the second fluid chamber 33*b*. On the other hand, the lower member 42*b* closes the lower side of the upper member 42*a* and defines the lower side of the discharge passage 43 to be described later. The lower side of the rear chamber 34*i* is not closed by the upper member 42*a* and the lower member 42*b* but open.

In the lower bearing 42, a part of the discharge passage 43 that guides a refrigerant from the second fluid chamber 33*b* to the discharge pipe 9 is formed. In the upper member 42*a,* a discharge port 43*a* is formed that allows the second fluid chamber 33*b* and the discharge passage 43 to communicate with each other. The discharge passage 43 is formed so as to pass through the cylinders 31*b* and 31*a* from the lower bearing 42 to reach the upper bearing 41. The discharge pipe 9 is connected to the upper bearing 41 so as to pass through a side part of the closed casing 10 to communicate with the discharge passage 43.

The upper bearing 41 is provided above the first expansion section 30*a*. The upper bearing 41 closes the upper sides of the cylinder 31*a* and the piston 32*a* of the first expansion section 30*a* and defines the upper side of the first fluid chamber 33*a*. In the upper bearing 41, the intake passage 44 is formed that guides the refrigerant from the intake pipe 8 to the first fluid chamber 33*a*. The intake pipe 8 penetrates through a side part of the closed casing 10 and is connected to the upper bearing 41 so as to communicate with the intake passage 44.

As described above, in this embodiment, the expansion mechanism 22 includes the upper bearing 41 (upper closing member) that closes the top end face of the cylinder 31*a* (first cylinder) of the first expansion section 30*a,* and the lower bearing 42 (lower closing member) that closes the bottom end face of the cylinder 31*b* (second cylinder) of the second expansion section 30*b*. The intake port 44*a* for drawing the refrigerant to be expanded into the fluid chamber 33*a* of the first expansion section 30*a,* the intake passage 44 that guides, to the intake port 44*a,* the refrigerant guided into the closed casing 10 by the intake pipe 8 (second intake pipe), and a part of the discharge passage 43 that guides the expanded refrigerant to the discharge pipe 9 (second discharge pipe) are formed in the upper bearing 41. The discharge port 43*a* for discharging the expanded refrigerant from the fluid chamber 33*b* of the second expansion section 30*b* is formed in the lower bearing 42. The discharge passage 43 that guides, to the discharge pipe 9, the refrigerant discharged from the fluid chamber 33*b* of the second expansion section 30*b* through the discharge port 43*a* also is formed inside the lower bearing 42, the cylinder 31*b,* the partition plate 39, and the cylinder 31*a* while extending vertically. The expanded refrigerant flows upwardly through the second expansion section 30*b* and the first expansion section 30*a* and reaches from the inside of the lower bearing 42 to the inside of the upper bearing 41. Furthermore, the intake pipe 8 penetrates through the closed casing 10 to be connected directly to the upper bearing 41 so that the refrigerant to be expanded flows directly into the intake passage 44 from the outside of the closed casing 10. The discharge pipe 9 penetrates through the closed casing 10 to be connected directly to the upper bearing 41 so that the expanded refrigerant flows out directly to the outside of the closed casing 10 from the discharge passage 43.

With such a configuration, since the intake pipe 8 and the discharge pipe 9 are connected to the upper bearing 41, the pipes can be connected easily. In other words, the assembly time can be shortened. Furthermore, since a part of the discharge passage 43 is located below the oil level OL, an effect of preventing heat transfer from the oil to the expansion mechanism 22 can be expected. Moreover, the discharge passage 43 is formed to be relatively long. Since the enthalpy of the expanded refrigerant increases during flowing through the discharge passage 43, it is advantageous in reducing the size of the evaporator 3 (see FIG. 1) of the refrigeration cycle apparatus 1. Particularly, when a part of the discharge passage 43 is formed inside the lower bearing 42 as in this embodiment, the volumetric capacity of the discharge passage 43 can be increased and an effect of increasing the enthalpy of the refrigerant also can be expected sufficiently.

The configuration of the expander-integrated compressor 5D according to the fourth embodiment was described above. Next, operation of the expander-integrated compressor 5D will be described. In this case, the compression mechanism 21 is the same as that used in the first embodiment and therefore the description thereof is not repeated. Hereinafter, operation of the expansion mechanism 22 is described.

The pistons 32*a* and 32*b* revolve in association with rotation of the rotating shaft 36. Accordingly, a high pressure refrigerant that has been drawn into the intake passage 44 from the intake pipe 8 flows into the first fluid chamber 33*a*. The high pressure refrigerant that has flowed into the first fluid chamber 33*a* is expanded in a space formed by the low-pressure side fluid chamber L1 of the first fluid chamber 33*a,* the communication hole 40, and the high-pressure side fluid chamber H2 of the second fluid chamber 33*b* and thereby is turned into the low pressure refrigerant. The low pressure refrigerant located in the second fluid chamber 33*b* flows into the discharge passage 43 through the discharge port 43*a*. The refrigerant rises inside the discharge passage 43, then flows into the discharge pipe 9, and is discharged to the outside of the closed casing 10 through the discharge pipe 9.

Next, an oil supply operation will be described. Since the operation of supplying the oil to the compression mechanism 21 is same as in the first embodiment, the description thereof is not repeated. Hereinafter, the operation of supplying the oil to the expansion mechanism 22 is described.

As described above, the oil is placed in the oil reservoir 15 in such a manner that the oil level OL is located above the lower end portion 34*f* of the vane 34*b,* more preferably, the expansion mechanism 22 is immersed in the oil. Therefore, the second expansion section 30*b* or both the second expansion section 30*b* and the first expansion section 30*a* are immersed in the oil. Furthermore, the upper side and the lower side of the rear chamber 34*i* of the second expansion section 30*b* are open, and the lower side of the rear chamber 34*h* of the first expansion section 30*a* also is open. Accordingly, the oil contained in the oil reservoir 15 enters through the above-mentioned openings into the vane groove 34*d* and the vane groove 34*c,* or the insides of the second expansion section 30*b* and the first expansion section 30*a* and then is supplied to each sliding part. This oil then lubricates and seals the sliding parts of the expansion mechanism 22.

As described above, this expander-integrated compressor 5D makes it possible to supply the oil to the compression mechanism 21 in preference to the expansion mechanism 22 as in the first embodiment, and to prevent operational instability caused by the shortage of lubricating oil in the compression mechanism 21. Furthermore, when the amount of the oil contained in the oil reservoir 15 is set to such a degree that the expansion mechanism 22 is immersed in the oil, the oil can be supplied to the vanes 34*a* and 34*b* reliably.

The lack of oil supply to the vanes 34*a* and 34*b* results in a deterioration in sealing performance, and thereby the refrigerant leaks out from the first fluid chamber 33*a* or the second fluid chamber 33*b*. Furthermore, the pressure difference between the inside and the outside of the second fluid chamber 33*b* located downstream is larger than that between the inside and the outside of the first fluid chamber 33*a* located upstream, inside the expansion mechanism 22. Therefore, a deterioration in the sealing performance of the vane 34*b* results in leaking out of a larger amount of refrigerant as compared to the case of a deterioration in the sealing performance of the vane 34*a*, which causes a deterioration in performance of the expansion mechanism 22.

However, in this expander-integrated compressor 5D, the second expansion section 30*b* is provided below the first expansion section 30*a*. Therefore, even when the oil contained in the oil reservoir 15 is reduced and the oil level OL is lowered, the oil level OL is prevented from being lowered since the oil can no longer be supplied to the vane 34*a* first. Accordingly, the expander-integrated compressor 5D makes it possible to avoid the shortage of oil supply to the vane 34*b* of the second expansion section 30*b* and thereby to prevent the performance of the expansion mechanism 22 from deteriorating.

Fifth Embodiment

Figure 7:
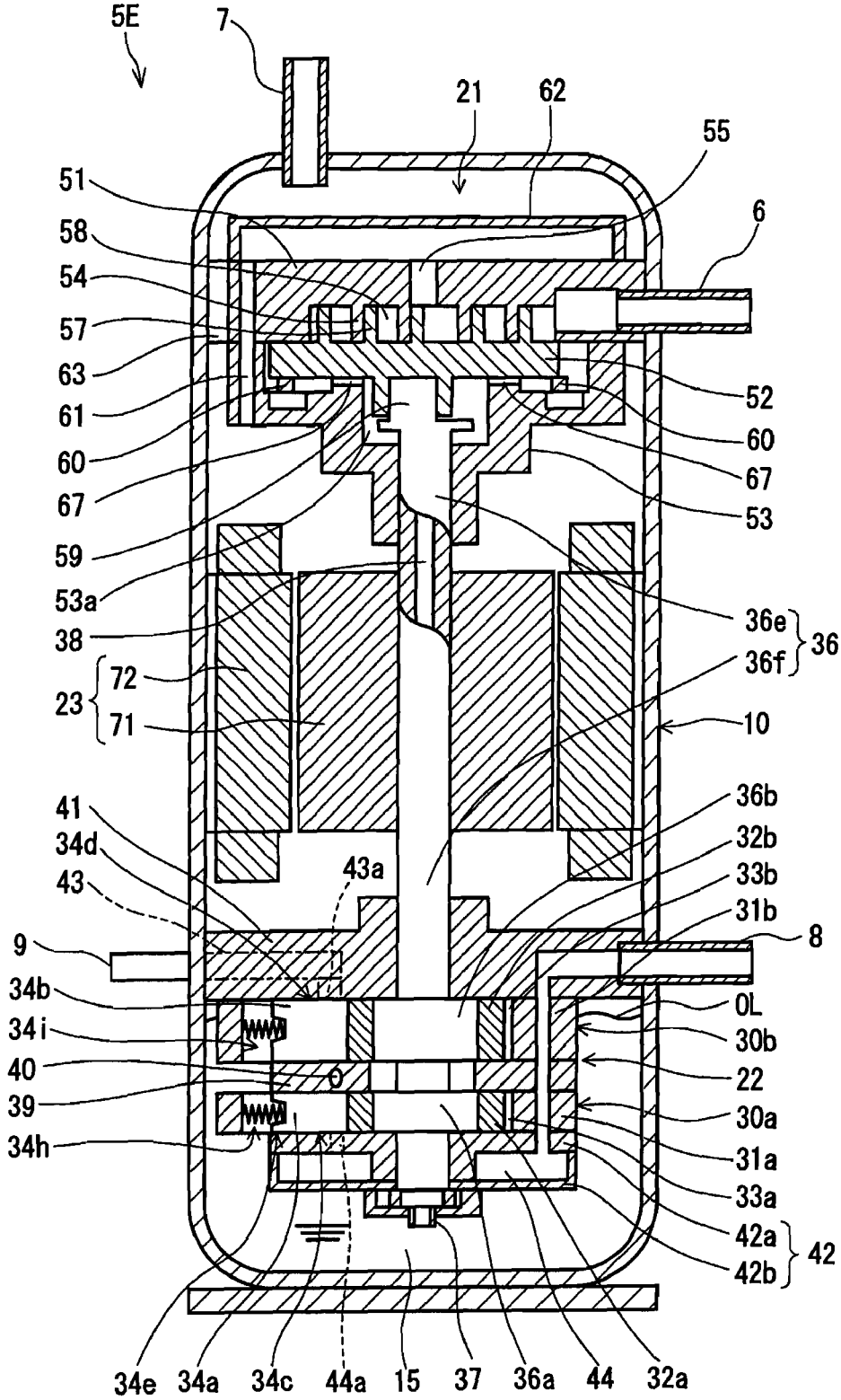
FIG. 7 is a vertical cross-sectional view of an expander-integrated compressor according to a fifth embodiment.

As shown in FIG. 7, in an expander-integrated compressor 5E according to this embodiment, the first expansion section 30*a* is provided below the second expansion section 30*b*. This configuration is in common with the first embodiment. In this embodiment, the expansion mechanism 22 includes the upper bearing 41 (upper closing member) that closes the top end face of the cylinder 31*b* of the second expansion section 30*b* and the lower bearing 42 (lower closing member) that closes the bottom end face of the cylinder 31*a* of the first expansion section 30*a*. The intake port 44*a* for drawing a refrigerant to be expanded into the fluid chamber 33*a* of the first expansion section 30*a* is formed in the lower bearing 42. The following is formed in the upper bearing 41: a part of the intake passage 44 that guides the refrigerant guided into the closed casing 10 by the intake pipe 8 (second intake pipe), to the intake port 44*a* formed in the lower bearing 42, the discharge port 43*a* for discharging the expanded refrigerant from the fluid chamber 33*b* of the second expansion section 30*b*, and the discharge passage 43 for guiding the refrigerant discharged from the fluid chamber 33*b* of the second expansion section 30*b* through the discharge port 43*a*, to the discharge pipe 9 (second discharge pipe). The intake passage 44 also is formed inside the cylinder 31*b*, a partition member 39, the cylinder 31*a*, and the lower bearing 42 while extending vertically. The refrigerant to be expanded flows downwardly from the top to the bottom in the second expansion section 30*b* and the first expansion section 30*a* and then reaches the inside of the lower bearing 42 from the inside of the upper bearing 41. Furthermore, the intake pipe 8 penetrates through the closed casing 10 to be connected directly to the upper bearing 41 so that the refrigerant to be expanded flows directly into the intake passage 44 from the outside of the closed casing 10. The discharge pipe 9 penetrates through the closed casing 10 to be connected directly to the upper bearing 41 so that the expanded refrigerant flows out directly to the outside of the closed casing 10 from the discharge passage 43. That is, the configuration of the passage of the refrigerant is in common with the fourth embodiment, but the refrigerant flow direction is opposite to that employed in the fourth embodiment.

In the expander-integrated compressor 5E according to this embodiment, the intake pipe 8 and the discharge pipe 9 are connected directly to the upper bearing 41. Therefore, as in the case of the first embodiment (see FIG. 2), the pipes can be connected easily as compared to the configuration in which the intake pipe 8 (or discharge pipe 9) is connected to the lower bearing 42 and the discharge pipe 9 (or intake pipe 8) is connected to the upper bearing 41. In other words, the assembly time can be shortened. Furthermore, since a part of the intake passage 44 is located below the oil level OL and the intake passage 44 is formed to be relatively long, the enthalpy of the refrigerant to be expanded is increased during the flow through the intake passage 44. In this case, an increase in recovery power of the expansion mechanism 22 can be expected. Particularly, when a part of the intake passage 44 is formed inside the lower bearing 42 as in this embodiment, the volumetric capacity of the intake passage 44 can be increased and a sufficient effect of increasing the enthalpy of the refrigerant also can be expected.

Sixth Embodiment

An expander-integrated compressor 5F according to this embodiment is different from those of the first to fifth embodiments in that the expansion mechanism 22 is located above the oil level OL. Oil supply to the compression mechanism 21 and the expansion mechanism 22 is performed with the oil pump 37 provided at the lower end of the rotating shaft 36.

Figure 8:
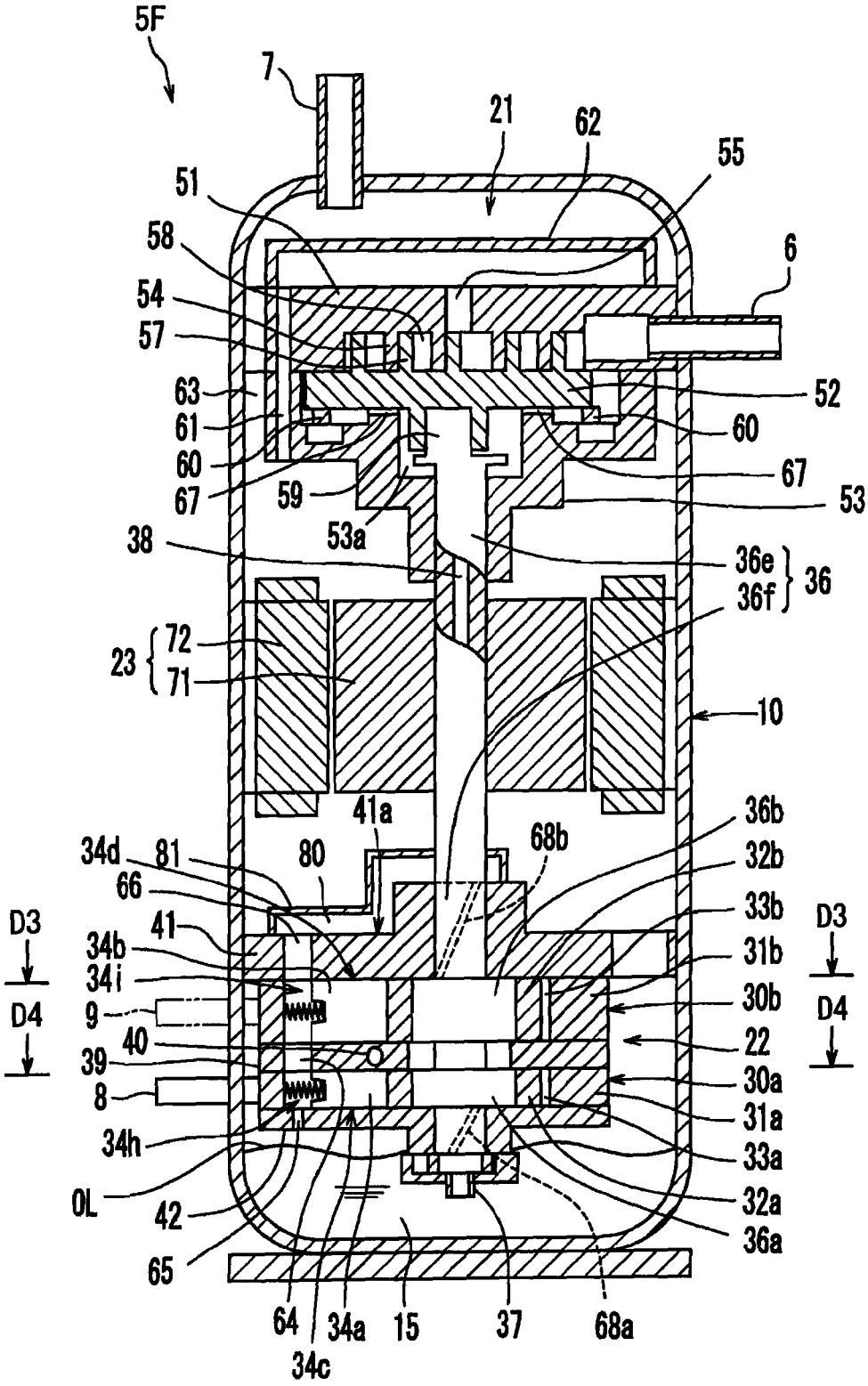
FIG. 8 is a vertical cross-sectional view of an expander-integrated compressor according to a sixth embodiment.

As shown in FIG. 8, the compression mechanism 21 and the expansion mechanism 22 of the expander-integrated compressor 5F are accommodated inside the closed casing 10. The expansion mechanism 22 is disposed below the compression mechanism 21, and the motor 23 is provided between the compression mechanism 21 and the expansion mechanism 22. The oil reservoir 15 for holding the oil is formed in the bottom portion inside the closed casing 10. The oil is placed in the oil reservoir 15 to such a degree that the oil level OL is located below the cylinder 31*a* of the first expansion section 30*a* to be described later.

First, the configuration of the expansion mechanism 22 is described. The expansion mechanism 22 includes the lower bearing 42, the first expansion section 30*a*, the second expansion section 30*b*, and the upper bearing 41. The first expansion section 30*a* is disposed below the second expansion section 30*b*. Furthermore, the upper bearing 41 is disposed above the second expansion section 30*b*, and the lower bearing 42 is disposed below the first expansion section 30*a*.

Figure 9A:
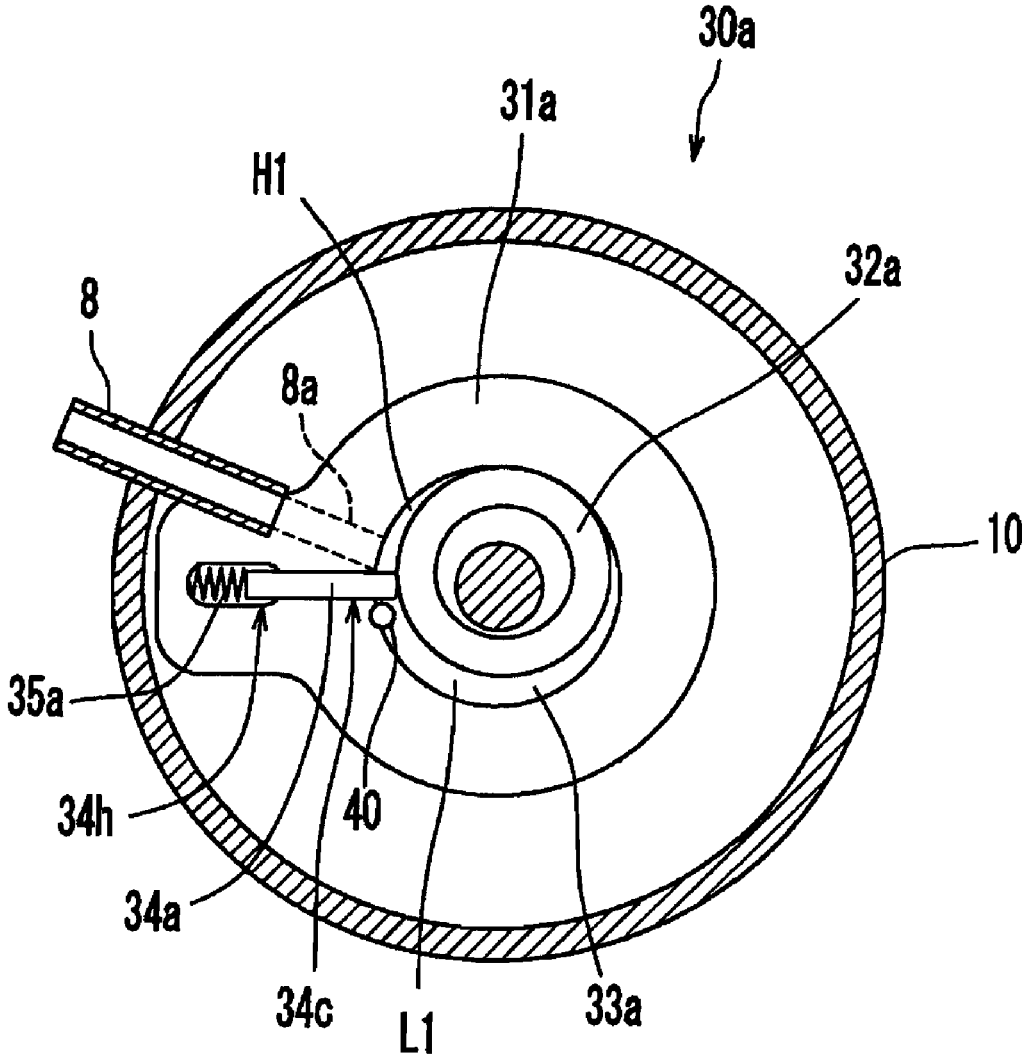
FIG. 9A is a cross-sectional view taken on line D4-D4 of FIG. 8.

FIG. 9A is a cross-sectional view taken on line D4-D4 of FIG. 8. The basic configuration of the first expansion section 30*a* is as described with respect to FIG. 2A. This embodiment is different from the first embodiment (FIG. 2A) in that the intake pipe 8 is connected directly to the cylinder 31*a*. That is, an intake port 8*a* that extends from the outside toward the high-pressure side fluid chamber H1 is formed in the cylinder 31*a*. One end of the intake pipe 8 is inserted into the intake port 8*a*.

Figure 9B:
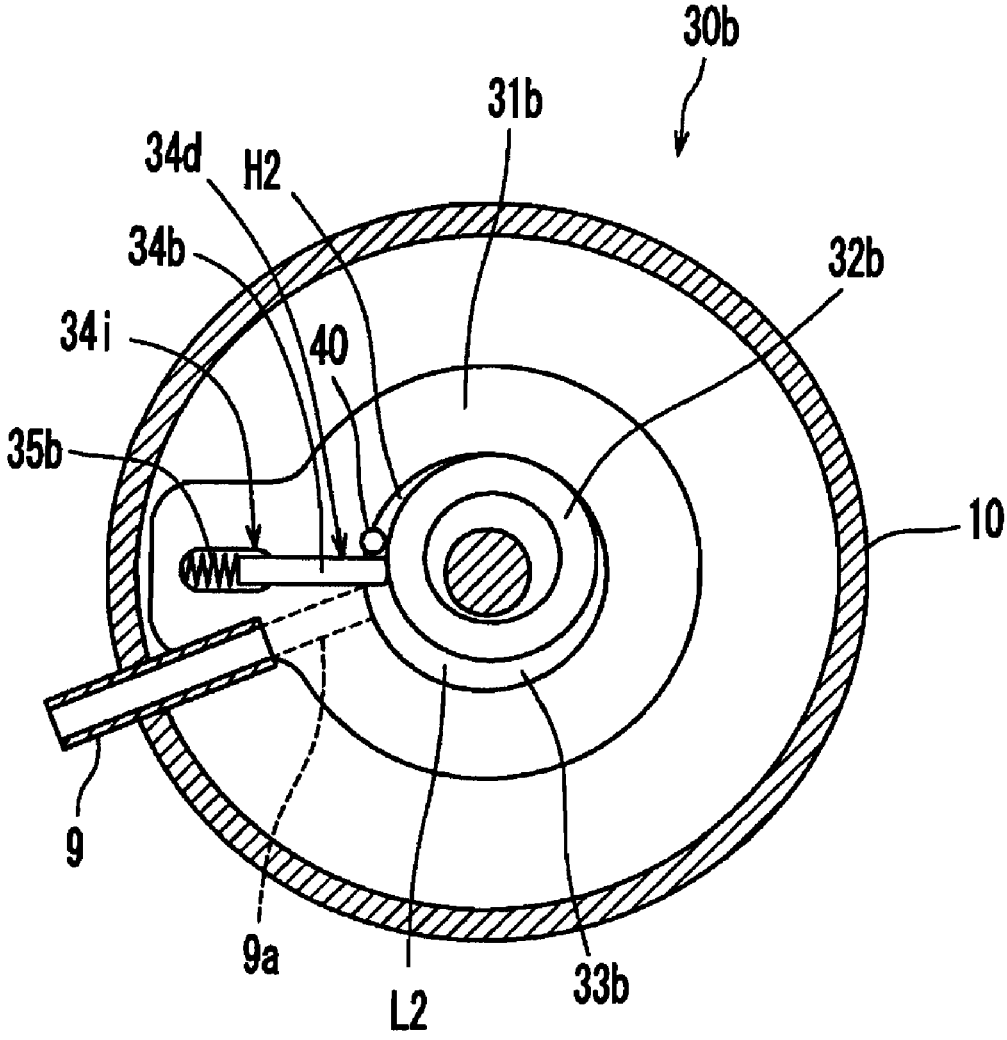
FIG. 9B is a cross-sectional view taken on line D3-D3 of FIG. 8.

FIG. 9B is a cross-sectional view taken on line D3-D3 of FIG. 8. The basic configuration of the second expansion section 30*b* is as described with respect to FIG. 2B. This embodiment is different from the first embodiment (FIG. 2B) in that the discharge pipe 9 is connected directly to the cylinder 31*b*. That is, a discharge port 9*a* that extends from the low-pressure side fluid chamber L2 toward the outside is formed in the cylinder 31*b*. One end of the discharge pipe 9 is inserted into the discharge port 9*a*.

As shown in FIG. 8, the communication hole 64 that allows the rear chamber 34*h* and the rear chamber 34*i* to communicate with each other is formed in the partition plate 39 that partitions the first expansion section 30*a* from the second expansion section 30*b*.

Furthermore, a lower through hole 65 that penetrates through from the upper face to the bottom face of the lower bearing 42 is formed in the portion of the lower bearing 42 located below the rear chamber 34*h*.

Furthermore, the upper through hole 66 that penetrates through from the upper face 41*a* to the bottom face of the upper bearing 41 is formed in the portion of the upper bearing 41 located above the rear chamber 34*i*.

The lower end of the rotating shaft 36 is immersed in the oil contained in the oil reservoir 15. The oil pump 37 for pumping the oil up is provided at the lower end of the rotating shaft 36. The axially and linearly extending oil supply passage 38 is formed inside the rotating shaft 36. Furthermore, the axially and spirally extending oil supply groove 68*a* is formed in the inner circumferential surface of the lower bearing 42, while the axially and spirally extending oil supply groove 68*b* is formed in the inner circumferential surface of the upper bearing 41. The oil supply groove 68*a* may be formed in the outer circumferential surface of a portion of the rotating shaft 36 that is supported by the lower bearing 42. Moreover, the oil supply groove 68*b* may be formed in the outer circumferential surface of a portion of the rotating shaft 36 that is supported by the upper bearing 41.

A cover 81 is provided above the upper face 41*a* of the upper bearing 41. The cover 81 integrally covers the upper through hole 66 and an outer circumference portion (outer circumference portion located above the upper bearing 41) of the rotating shaft 36 and forms one closed space 80 above the upper face 41*a* of the upper bearing 41. Thus, the oil that has flowed out to the upper face 41*a* of the upper bearing 41 from the oil supply groove 68*b* of the rotating shaft 36 is guided to the upper through hole 66, flows into the space formed by the rear chamber 34*i*, the communication hole 64, and the rear chamber 34*h*, and then is held. Furthermore, a part thereof is returned to the oil reservoir 15 through the lower through hole 65.

Next, oil supply operation to the expansion mechanism 22 is described.

In association with rotation of the rotating shaft 36, the oil contained in the oil reservoir 15 is pumped up by the oil pump 37 and rises in the oil supply groove 68*a* while lubricating the sliding parts between the lower bearing 42 and the rotating shaft 36. The oil located in the oil supply groove 68*a* then is supplied to the first eccentric portion 36*a* and the second eccentric portion 36*b* of the rotating shaft 36 and sliding parts of the piston 32*a* and the piston 32*b* and thereby lubricates and seals each sliding part. The oil that has lubricated each sliding part is guided by the oil supply groove 68*b* and rises while lubricating the sliding part between the upper bearing 41 and the rotating shaft 36. The oil that then reached the top end portion of the oil supply groove 68*b* flows out to the upper face 41*a* of the upper bearing 41.

The oil that has flowed out to the upper face 41*a* of the upper bearing 41 passes through the closed space 80 formed by the cover 81 and then flows into the rear chamber 34*i* of the cylinder 31*b* from the upper through hole 66. The oil then is held inside the space formed by the rear chamber 34*i*, the communication hole 64, and the rear chamber 34*h*. The oil thus held flows inside the vane grooves 34*c* and 34*d* from the rear sides toward the leading end sides of the vanes 34*a* and 34*b* due to the pressure difference between the insides and the outsides of the respective fluid chambers 33*a* and 33*b*. The oil then lubricates and seals the gap between the vane 34*b* and the vane groove 34*d* as well as the gap between the vane 34*a* and the vane groove 34*c*. Furthermore, part of the oil falls from the lower through hole 65 of the lower bearing 42 toward the oil reservoir 15.

In this embodiment, the oil that rises through the oil supply passage 38 located inside the rotating shaft 36 is supplied only to the compression mechanism 21 and is not supplied to the expansion mechanism 22. However, a through hole that extends in a direction crossing the axis direction is provided in the mid portion of the rotating shaft 36, and the oil in the oil supply passage 38 may be supplied to the sliding parts of the expansion mechanism 22 through the through hole.

As described above, in the expander-integrated compressor 5F according to this embodiment, the oil pump 37 allows the oil contained in the oil reservoir 15 to pass through the oil supply groove 68*a*, the oil supply groove 68*b*, the upper face 41*a* of the upper bearing 41, and the upper through hole 66 to flow into the space formed by the rear chamber 34*i*, the communication hole 64, and the rear chamber 34*h* and to be held therein. Furthermore, the oil held in the above-mentioned space flows inside the vane grooves 34*c* and 34*d* from the rear sides toward the leading end sides of the vanes 34*a* and 34*b* due to the pressure difference between the insides and the outsides of the respective fluid chambers 33*a* and 33*b*. Thus, the oil contained in the oil reservoir 15 can be supplied to the whole region extending from the rear side ends to the leading ends of the vanes 34*a* and 34*b* located far away from the rotating shaft 36. Accordingly, the vanes 34*a* and 34*b* can be lubricated sufficiently, and the gaps between the vanes 34*a* and 34*b* and the groove portions 34*c* and 34*d* can be sealed well. Therefore, this expander-integrated compressor 5F makes it possible to reduce the amount of the oil contained in the oil reservoir 15 and thereby to prevent the expansion mechanism 22 from being immersed in the oil contained in the oil reservoir 15. Thus, this expander-integrated compressor 5F makes it possible to prevent heat transfer from the oil to the refrigerant in the expansion mechanism 22.

The oil contained in the oil reservoir 15 is pumped up continuously by the oil pump 37 and then is guided to the oil supply groove 68*a* and the oil supply groove 68*b*. Therefore, the oil guided upward through the oil supply groove 68*b* eventually flows out to the upper face 41*a* of the upper bearing 41 from the contact surface between the upper bearing 41 and the rotating shaft 36. Since the oil contained in the oil reservoir 15 has a high temperature, the oil that has flowed out to the upper face 41*a* of the upper bearing 41 also has a relatively high temperature. Therefore, when such a high temperature oil is pooled on the upper face 41*a*, the upper bearing 41 is heated and further the refrigerant in the second fluid chamber 33*b* in turn is heated.

However, in this expander-integrated compressor 5F, the oil that flowed out to the upper face 41*a* of the upper bearing 41 passes through the upper through hole 66 and then flows into the space formed by the rear chamber 34*i*, the communication hole 64, and the rear chamber 34*h*. Therefore, the oil can be supplied to the vanes 34*a* and 34*b* and also can be prevented from being pooled on the upper face 41*a* of the upper bearing 41. Accordingly, this expander-integrated compressor 5F makes it possible to supply a sufficient amount of the oil to the vanes 34*a* and 34*b* of the expansion mechanism 22 and to prevent heat transfer from the oil to the refrigerant in the expansion mechanism 22, with a simple configuration.

The cover 81 is fixed to the upper bearing 41 of this expander-integrated compressor 5F. The cover 81 integrally covers the upper through hole 66 and the outer circumference portion of the rotating shaft 36 above the upper face 41*a* and forms one closed space 80 above the upper face 41*a* of the upper bearing 41. This makes it possible to guide all of the oil that has flowed out to the upper face 41*a* of the upper bearing 41 to the upper through hole 66. Accordingly, the oil can be supplied to the vanes 34*a* and 34*b* reliably. Furthermore, when a part of the upper face 41*a* of the upper bearing 41 is covered with the cover 81, the oil that has flowed out to the upper face 41*a* of the upper bearing 41 can be pooled in a part of the upper face 41*a* and thereby can be prevented from being spread to the other part. Therefore, heat of the oil further can be prevented from being transferred to the upper bearing 41.

The cover 81 may be any one as long as it smoothly guides the oil that has flowed out to the upper face 41*a* of the upper bearing 41, to the upper through hole 66. Therefore, it can be one that does not form the closed space 80 as described above or one that does not guide all of the oil that has flowed out to the upper face 41*a* of the upper bearing 41, to the upper through hole 66.

An oil supply groove that connects the oil supply groove 68*b* and the upper through hole 66 may be formed in the upper face 41*a* of the upper bearing 41, with the cover 81 being not provided. Alternatively, the upper face 41*a* of the upper bearing 41 may be formed to be inclined downward from the rotating shaft 36 side toward the upper through hole 66, with the cover 81 being not provided. Similarly by forming the upper bearing 41 in such a form, the oil that has flowed out to the upper face 41*a* of the upper bearing 41 from the oil supply groove 68*b* can be guided to the upper through hole 66. It should be appreciated that the cover 81 can be provided in addition to the upper bearing 41 formed in such a form.

Furthermore, in this expander-integrated compressor 5F, part of the oil that has flowed from the upper through hole 66 into the space formed by the rear chamber 34*i*, the communication hole 64, and the rear chamber 34*h* is returned to the oil reservoir 15 through the lower through hole 65. That is, the upper through hole 66, the rear chamber 34*i*, the communication hole 64, the rear chamber 34*h*, and the lower through hole 65 of this expander-integrated compressor 5F configure a return passage, through which the oil that has flowed out to the upper face 41*a* of the upper bearing 41 is returned to the oil reservoir 15. Therefore, the oil that has flowed out to the upper face 41*a* of the upper bearing 41 lubricates and seals the vanes 34*a* and 34*b* and then is returned to the oil reservoir 15. Accordingly, this expander-integrated compressor 5F makes it possible to supply the oil to the vanes 34*a* and 34*b* and also to return the oil that has flowed out to the upper face 41*a* of the upper bearing 41 to the oil reservoir 15, with a simple configuration. Furthermore, when the oil return passage also is used as a passage for supplying the oil to the vanes 34*a* and 34*b*, the number of the holes through which the oil is passed can be reduced.

In this expander-integrated compressor 5F, the oil that rises through the oil supply passage 38 located inside the rotating shaft 36 is supplied only to the compression mechanism 21 and is not supplied to the expansion mechanism 22. As described above, when separate oil supply passages are used for the expansion mechanism 22 and the compression mechanism 21, the oil can be supplied to the compression mechanism 21 more reliably.

In this embodiment, carbon dioxide was used as the refrigerant. Generally, oil can blend into carbon dioxide in a supercritical state relatively easily. Therefore, an oil shortage tends to occur inherently in expander-integrated compressors using carbon dioxide as the refrigerant. However, as described above, this expander-integrated compressor 5F makes it possible to supply a sufficient amount of the oil to the vanes 34*a* and 34*b* and thereby to prevent oil shortage effectively. Accordingly, when carbon dioxide is used as a working fluid, the effects described above can be exhibited further significantly.

As described above, the expander-integrated compressor 5F of this embodiment can prevent heat transfer from the oil contained in the oil reservoir 15 to the expansion mechanism 22. Therefore, the temperature of the refrigerant discharged from the compression mechanism 21 can be prevented from decreasing, and when the expander-integrated compressor 5F is used in the refrigeration cycle apparatus shown in FIG. 1, the amount of heat exchange in the radiator 2 can be prevented from decreasing. Furthermore, although the refrigerant in a gas-liquid two-phase state is discharged from the expansion mechanism 22, since heat transfer from the oil to the expansion mechanism 22 can be prevented, an increase in dryness of the discharge refrigerant can be prevented. Accordingly, a decrease in the amount of heat exchange in the evaporator 3 can be reduced.

As described above, this embodiment makes it possible to reduce the decrease in COP in a refrigeration cycle that is caused by heat transfer from the compression mechanism 21 to the expansion mechanism 22 and to obtain a refrigeration cycle apparatus of a mechanical power recovery type with high efficiency.

Seventh Embodiment

In the sixth embodiment, the oil supply passage, through which the oil that has passed through the oil supply grooves 68*a* and 68*b* is supplied to the vanes 34*a* and 34*b*, was formed by the upper through hole 66. Therefore, after flowing out to the upper face 41*a* of the upper bearing 41, the oil guided upward through the oil supply grooves 68*a* and 68*b* passes through the upper through hole 66, flows into the space formed by the rear chamber 34*i*, the communication hole 64, and the rear chamber 34*h*, and then lubricates the vanes 34*a* and 34*b*. However, the oil supply passage, through which the oil is guided from the oil supply grooves 68*a* and 68*b* to the vanes 34*a* and 34*b*, is not limited thereto.

Figure 10:
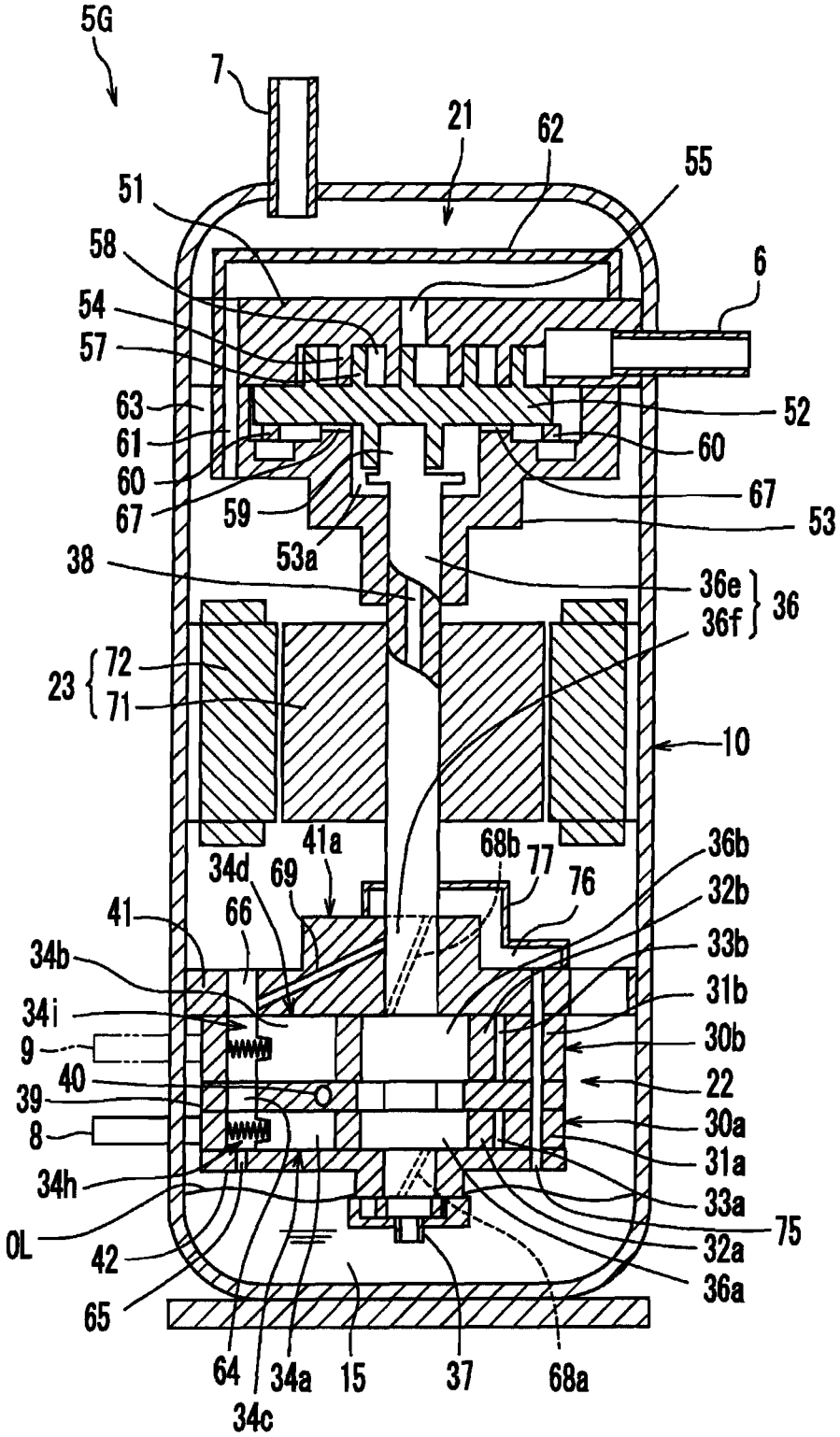
FIG. 10 is a vertical cross-sectional view of an expander-integrated compressor according to a seventh embodiment.

As shown in FIG. 10, in an expander-integrated compressor 5G according to the seventh embodiment, the upper communication hole 69 that extends from the oil supply groove 68*b* to the upper through hole 66 is formed inside the upper bearing 41. Therefore, the oil guided by the oil supply groove 68*b* flows into the upper communication hole 69 and then is guided through the upper through hole 66 into the space formed by the rear chamber 34*i*, the communication hole 64, and the rear chamber 34*h*. In this manner, when a passage that extends from the oil supply groove 68*b* to the rear chamber 34*i* is formed by the upper communication hole 69 and the upper through hole 66, the oil can be supplied to the vanes 34*a* and 34*b* through the passage. Accordingly, this embodiment also makes it possible to obtain the same advantageous effects as in the sixth embodiment.

The aforementioned upper communication hole 69 may be formed to allow the oil supply groove 68*b* and the rear chamber 34*i* to communicate directly with each other without using the upper through hole 66. Such an upper communication hole 69 also allows the oil to be supplied to the vanes 34*a* and 34*b*. In this case, the upper through hole 66 need not be provided.

When the upper through hole 66 is not provided, the oil that has flowed out to the upper face 41*a* of the upper bearing 41 from the oil supply groove 68*b* cannot be returned to the oil reservoir 15. Therefore, in such a case, it is preferable that the upper bearing 41, the cylinders 31*b* and 31*a*, and the lower bearing 42 be provided with a through hole 75 that integrally penetrates therethrough. In this case, the through hole 75 serves as a return passage and the oil that has flowed out to the upper face 41*a* of the upper bearing 41 can be returned to the oil reservoir 15. Therefore, the oil can be prevented from being pooled on the upper face 41*a*. Thus, similarly in this embodiment, heat transfer from the oil to the expansion mechanism 22 can be prevented.

Furthermore, when the upper through hole 66 is not provided but the through hole 75 is provided, a cover 77 that integrally covers the through hole 75 and the outer circumference portion of the rotating shaft 36 and that forms one closed space 76 above the upper face 41*a* of the upper bearing 41 may be provided instead of the cover 81 (see FIG. 8) of the sixth embodiment. This allows all of the oil that has flowed out to the upper face 41*a* of the upper bearing 41 to be guided to the through hole 75 without flowing into the upper communication hole 69. Furthermore, when a part of the upper face 41*a* of the upper bearing 41 is covered with the cover 77, the oil that has flowed out to the upper face 41*a* of the upper bearing 41 can be pooled in a part of the upper face 41*a* and thereby can be prevented from being spread to the other part. Therefore, this embodiment makes it possible further to prevent heat of the oil from being transferred to the upper bearing 41. Accordingly, it becomes possible further to prevent heat transfer from the oil to the refrigerant in the expansion mechanism 22.

Eighth Embodiment

Figure 11:
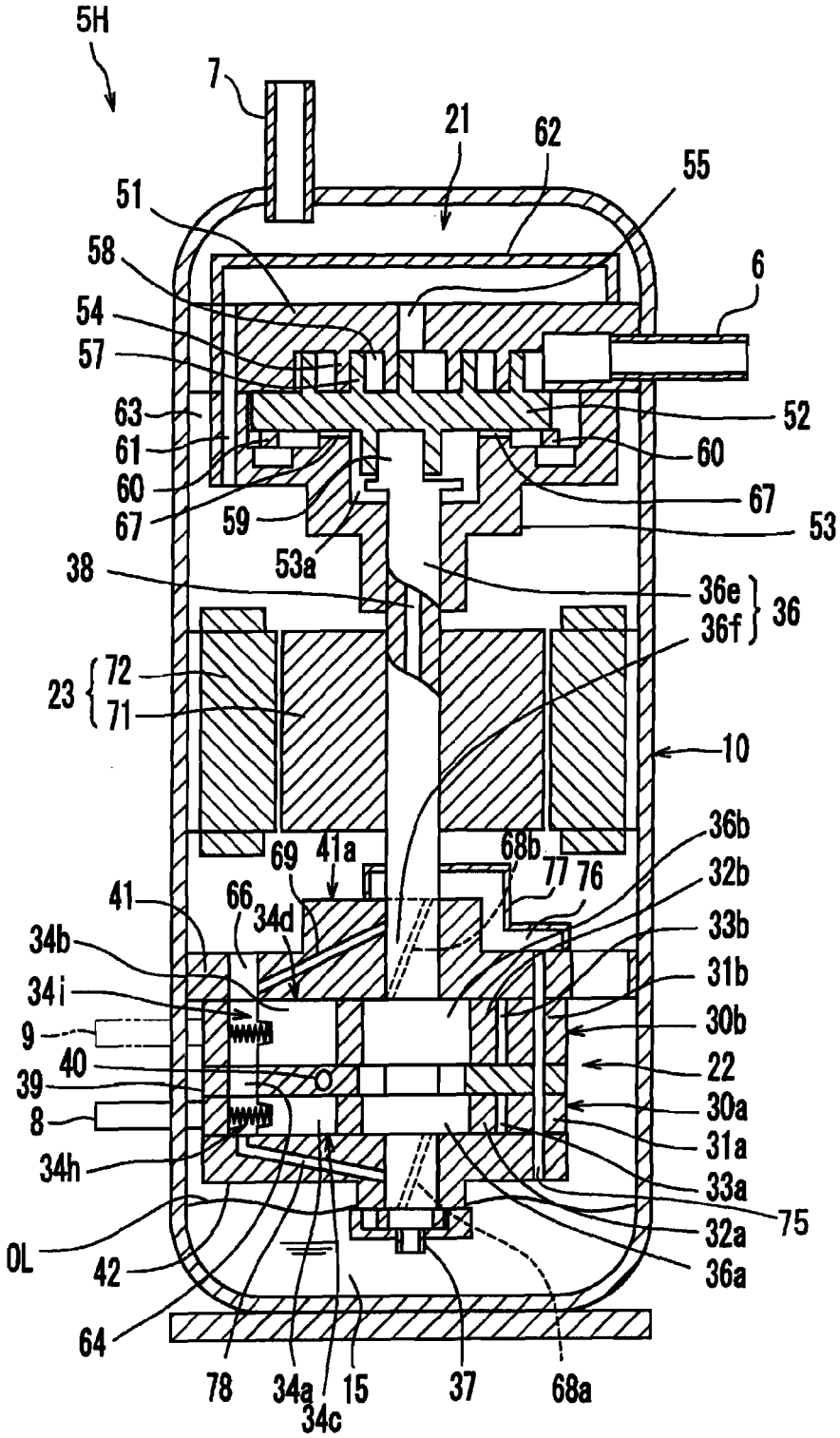
FIG. 11 is a vertical cross-sectional view of an expander-integrated compressor according to an eighth embodiment.

As shown in FIG. 11, in an eighth embodiment, the lower communication hole 78 that extends from the oil supply groove 68*a* to the rear chamber 34*h* is formed inside the lower bearing 42. Accordingly, part of the oil that flows through the oil supply groove 68*a* passes through the lower communication hole 78 to be guided to the space formed by the rear chamber 34*h*, the communication hole 64, and the rear chamber 34*i*. The oil can be supplied to the vanes 34*a* and 34*b* also through such a lower communication hole 78, and thereby it is possible to obtain the same advantageous effects as in the sixth embodiment.

Furthermore, in the upper bearing 41 of this expander-integrated compressor 5H, the upper communication hole 69 described in the seventh embodiment also is formed. Therefore, in this expander-integrated compressor 5H, the oil can be supplied to the vanes 34*a* and 34*b* using both the communication holes 69 and 78 as oil supply passages. Accordingly, the vanes 34*a* and 34*b* can be lubricated further reliably and the gaps located around the vanes 34*a* and 34*b* can be sealed. The lower communication hole 78 may be formed only in the lower bearing 42, with the upper communication hole 69 being not formed in the upper bearing 41. Even in this case, the vanes 34*a* and 34*b* can be lubricated and sealed.

Ninth Embodiment

Figure 12:
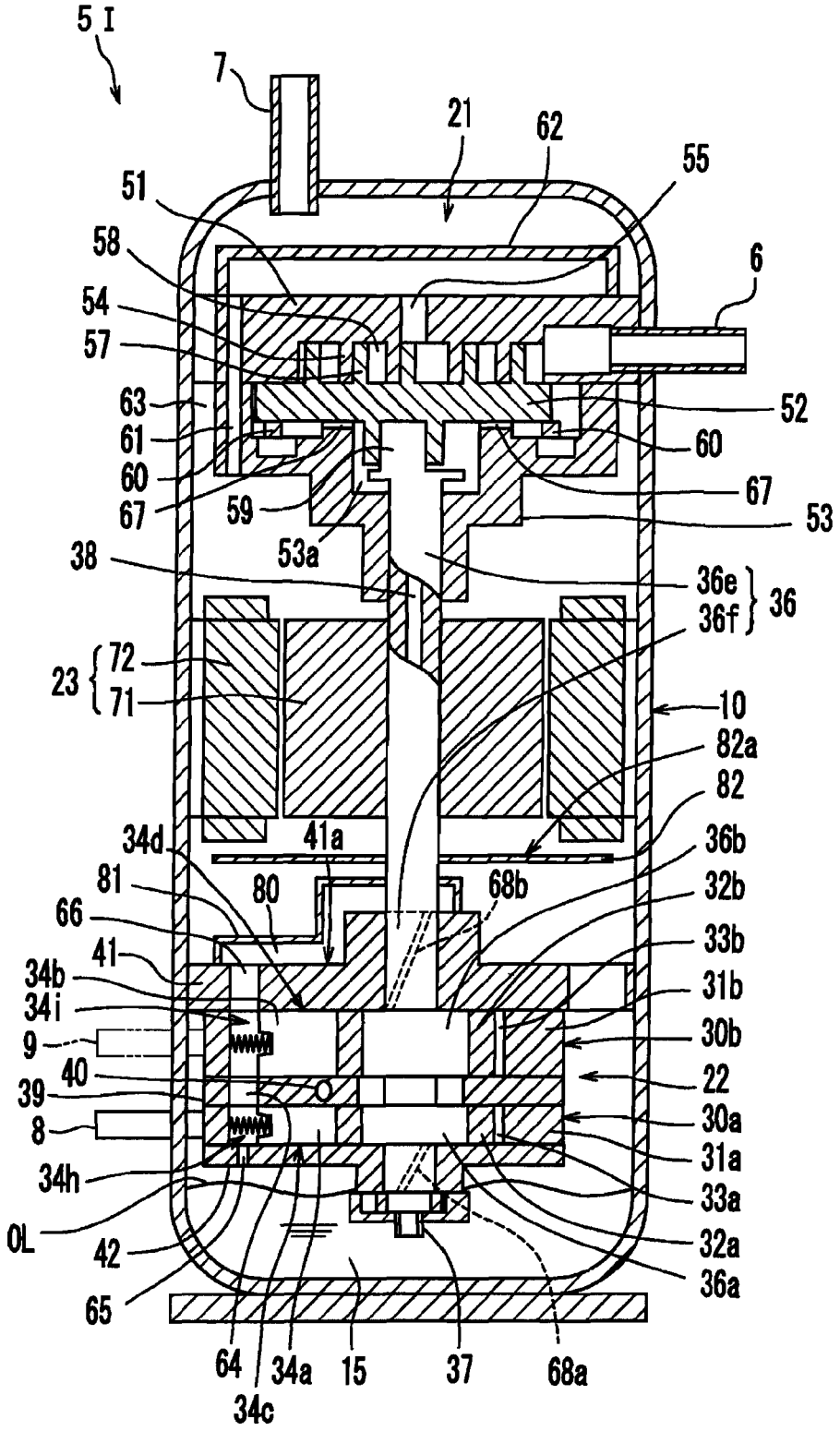
FIG. 12 is a vertical cross-sectional view of an expander-integrated compressor according to a ninth embodiment.

The oil supplied to the compression mechanism 21 is supplied to each sliding part of the compression mechanism 21 to be used for lubrication or sealing and then is discharged from the lower end of the bearing 53 of the compression mechanism 21. The oil discharged from the compression mechanism 21 falls due to gravitational force to be returned to the oil reservoir 15 located in the bottom portion of the closed casing 10. However, in falling, part of the oil may adhere to the upper face 41*a* of the upper bearing 41. Furthermore, the oil is heated by the compression mechanism 21 and thereby has a relatively high temperature. Therefore, when the upper face 41*a* of the upper bearing 41 is wetted by the oil, heat is transferred from the oil to the upper bearing 41 to heat the expansion mechanism 22. Therefore, as shown in FIG. 12, in an expander-integrated compressor 51 according to the ninth embodiment, an upper cover 82 formed of a substantially disk-shaped plate-like body is provided above the upper bearing 41.

Accordingly, the high temperature oil discharged from the compression mechanism 21 can be prevented from adhering to the upper face 41*a* of the upper bearing 41. Therefore, the expansion mechanism 22 can be prevented from being heated by the high temperature oil discharged from the compression mechanism 21. Thus, this embodiment makes it possible to prevent heat transfer from the compression mechanism 21 to the expansion mechanism 22.

The upper cover 82 may be fixed to the rotating shaft 36 or may be fixed to a side part of the closed casing 10. When the upper cover 82 is fixed to the rotating shaft 36, the upper cover 82 also rotates in association with rotation of the rotating shaft 36. In this case, the high temperature oil that has adhered to an upper face 82*a* of the upper cover 82 is scattered radially and outwardly due to centrifugal force generated by rotation of the upper cover 82. The oil thus scattered then adheres to the inner wall of the side part of the closed casing 10 due to its viscosity, and then falls to the oil reservoir 15 along the inner wall of the side part due to gravitational force. Therefore, this embodiment allows the oil discharged from the compression mechanism 21 to be returned to the oil reservoir 15 quickly.

Furthermore, the upper cover 82 is not limited to that described above but can be any one. The upper cover 82 can provide the effects as described above as long as at least a part thereof overlaps with the upper bearing 41 in a planar view.

Figure 13:
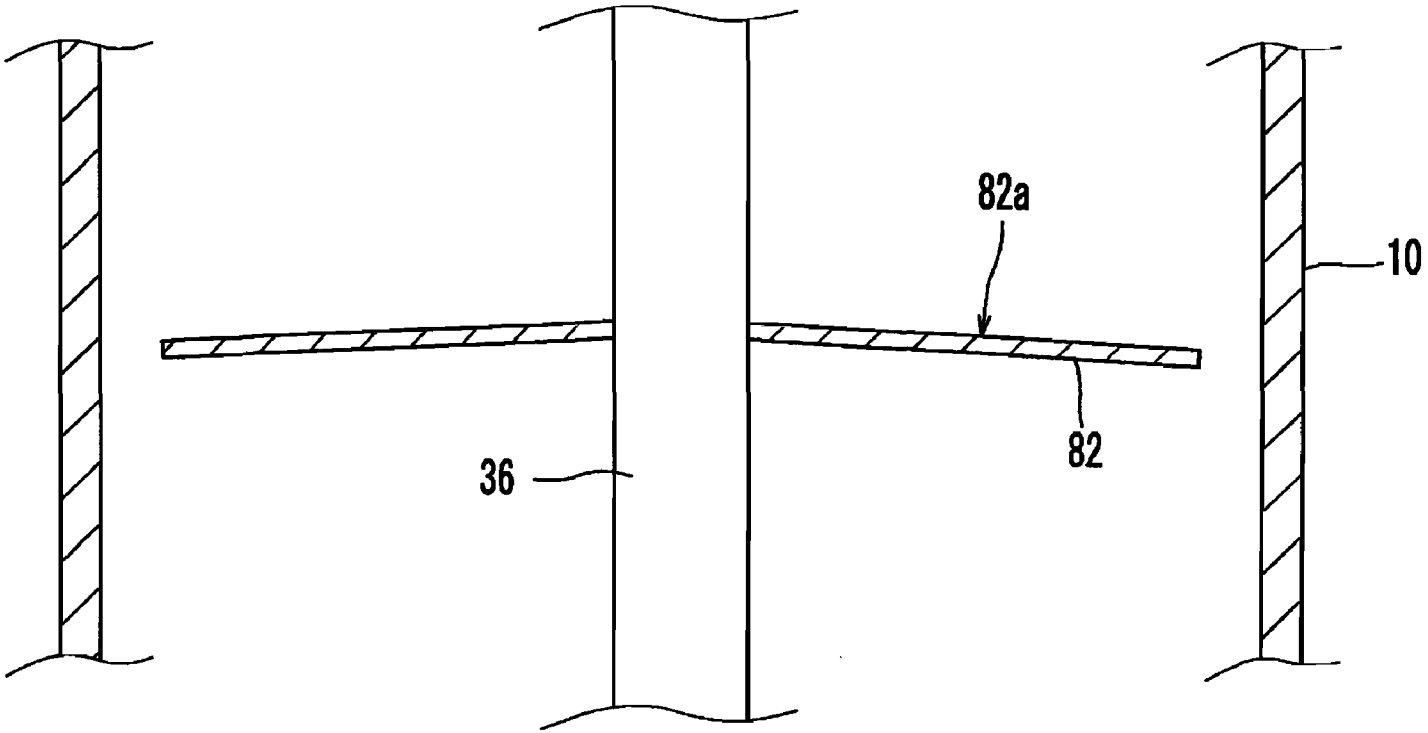
FIG. 13 is a vertical cross-sectional view showing an upper cover according to a modified example.

Furthermore, although the shape of the upper cover 82 is not limited, it may be formed to be inclined downwardly toward the radially outer side of the rotating shaft 36, as shown in FIG. 13. Such an upper cover 82 allows the oil that has adhered to the upper face 82*a* to be returned to the oil reservoir 15 more quickly. Furthermore, such a shape makes it possible to guide the oil that has adhered to the upper face 82*a* to a radially outer side and thereby to return it to the oil reservoir 15 even when the upper cover 82 does not rotate together with the rotating shaft 36.

Tenth Embodiment

Figure 14:
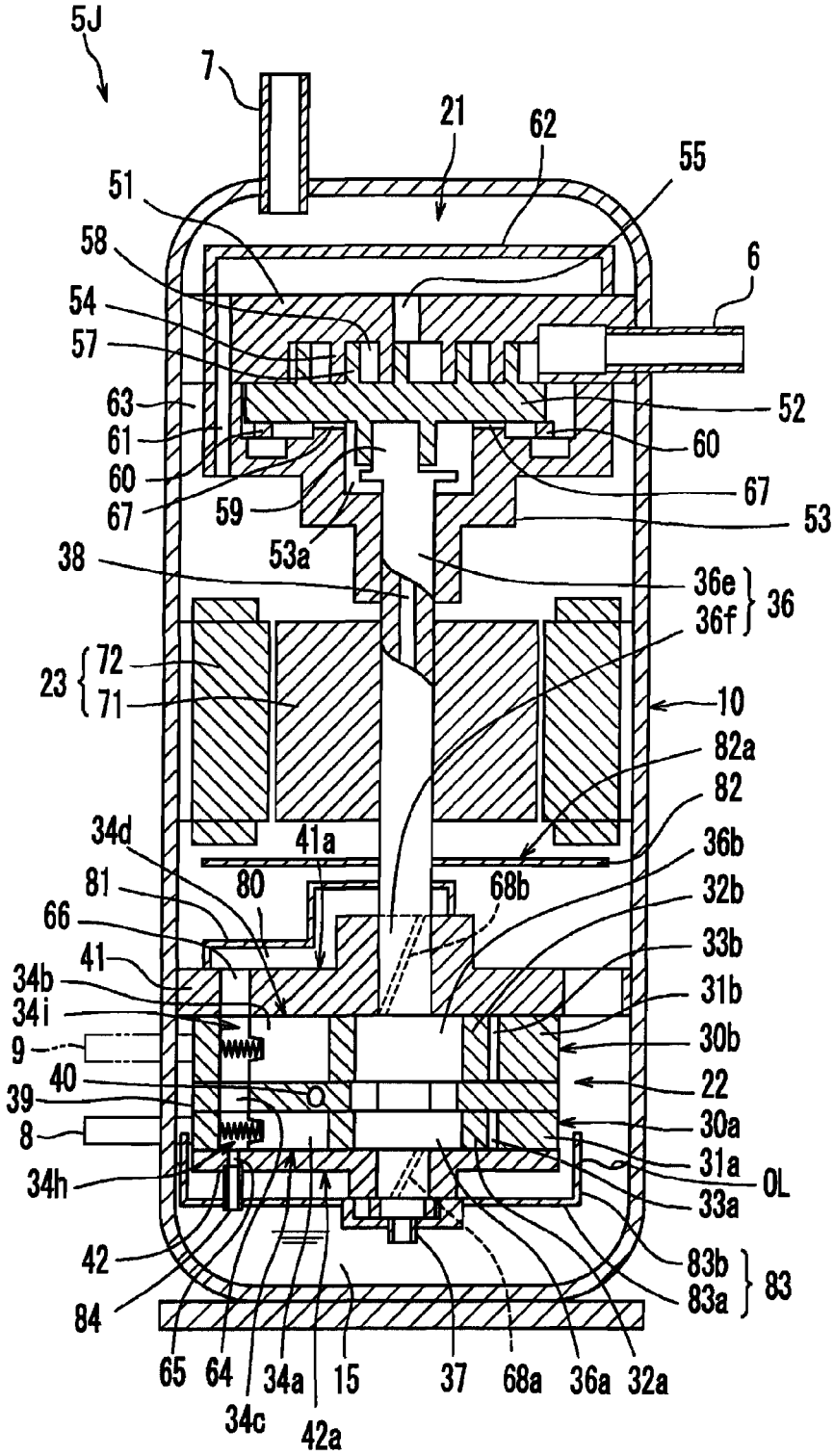
FIG. 14 is a vertical cross-sectional view of an expander-integrated compressor according to a tenth embodiment.

As shown in FIG. 14, an expander-integrated compressor 5J according to the tenth embodiment is obtained with a lower cover 83 added to the expander-integrated compressor 51 according to the ninth embodiment. The lower cover 83 is provided below the lower bearing 42. The lower cover 83 has a bottom plate 83*a* located below the expansion mechanism 22 and a side plate 83*b* that rises upward from the outer circumference portion of the bottom plate 83*a* and that extends to a higher position than that of the lower end of the expansion mechanism 22. In this case, the lower end of the expansion mechanism 22 refers to a lower face 42*a* of the lower bearing 42. As shown in the drawing, the top end portion of the side plate 83*b* is located above the lower face 42*a*. With such a shape, the lower cover 83 separates the oil contained in the oil reservoir 15 and the expansion mechanism 22 from each other.

Furthermore, a return pipe 84 that extends from the lower through hole 65 of the lower bearing 42 to the oil reservoir 15 located below the bottom plate 83*a* penetrates through the bottom plate 83*a*. The side plate 83*b* may rise obliquely and upwardly from the outer circumference portion of the bottom plate 83*a* and may extend to a higher position than that of the lower end of the expansion mechanism 22.

The expander-integrated compressor 5J described above can prevent the oil contained in the oil reservoir 15 from being brought into contact with the expansion mechanism 22 by using the lower cover 83 even when the amount of the oil contained in the oil reservoir 15 increases and the oil level OL reaches the vicinity of the top end portion of the lower bearing 42. Therefore, in this embodiment, even when the oil level OL in the oil reservoir 15 has been changed to increase, heat transfer from the oil contained in the oil reservoir 15 to the expansion mechanism 22 can be prevented.

Furthermore, since the return pipe 84 is provided, even when the lower cover 83 is provided, the oil that has flowed into the space formed by the rear chamber 34*i*, the communication hole 64, and the rear chamber 34*h* can be returned to the oil reservoir 15 from the lower through hole 65 through the return pipe 84.

Furthermore, similarly in this expander-integrated compressor 5J, since the upper cover 82 is provided, the expansion mechanism 22 can be prevented from being heated by the high temperature oil discharged from the compression mechanism 21. Therefore, heat transfer from the compression mechanism 21 to the expansion mechanism 22 can be prevented effectively. The upper cover 82 is not always necessary. It should be appreciated that with only the lower cover 83 being provided while the upper cover 82 is not provided, heat transfer from the compression mechanism 21 to the expansion mechanism 22 can be prevented.

As described above, in this specification, some embodiments were described but the present invention is not limited thereto. Furthermore, it should be appreciated that two or more embodiments may be combined together in the scope where they do not depart from the spirit of the present invention, and embodiments of such combinations are embraced in the present invention.

INDUSTRIAL APPLICABILITY

As described above, the present invention is useful for expander-integrated compressors, each of which has a compression mechanism for compressing a fluid and an expansion mechanism for expanding the fluid, and refrigeration cycle apparatuses (for example, a refrigeration apparatus, an air conditioner, and a hot water heater) provided therewith.

The invention claimed is:

1. An expander-integrated compressor, comprising:

a closed casing in which an oil reservoir for holding oil is formed in a bottom portion, a compression mechanism provided inside the closed casing, and for compressing a fluid and discharging the fluid into the closed casing, an expansion mechanism provided below the compression mechanism inside the closed casing, and for expanding the fluid, the expansion mechanism including a cylinder, a piston for forming a fluid chamber between the cylinder and itself, a groove portion formed in the cylinder, a partition member inserted slidably in the groove portion to partition the fluid chamber into a high-pressure side fluid chamber and a low-pressure side fluid chamber, and a rear chamber that is formed in the cylinder on a rear side of the partition member and that communicates with the groove portion, a first intake pipe penetrating through the closed casing and connected to a suction side of the compression mechanism, a first discharge pipe connected to the closed casing, with one end thereof being open into the closed casing, a second intake pipe penetrating through the closed casing and connected to a suction side of the expansion mechanism, a second discharge pipe penetrating through the closed casing and connected to a discharge side of the expansion mechanism, a rotating shaft extending vertically, and including an upper rotating portion for rotating the compression mechanism and a lower rotating portion subjected to a torque by the piston of the expansion mechanism, a suction mechanism provided at the lower end of the rotating shaft, and for drawing the oil from the oil reservoir, and an oil supply passage for supplying the oil drawn by the suction mechanism to the rear chamber of the expansion mechanism.

2. The expander-integrated compressor according to claim 1, further comprising a bearing for supporting the lower rotating portion of the rotating shaft, wherein the oil supply passage includes:

a first oil supply passage formed on an outer circumferential side of the lower rotating portion or on an inner circumferential side of the bearing, and for supplying the oil drawn by the suction mechanism upwardly, and a second oil supply passage for supplying, to the rear chamber, the oil passed through at least a part of the first oil supply passage.

3. The expander-integrated compressor according to claim 2, wherein the bearing has an upper bearing that supports a portion of the lower rotating portion located above the cylinder, an upper through hole extending from an upper face of the upper bearing to the rear chamber and for guiding, to the rear chamber, the oil flowed out to the upper face of the upper bearing from the first oil supply passage, is formed in the upper bearing, and the second oil supply passage is configured by the upper through hole.

4. The expander-integrated compressor according to claim 3, further comprising a cover for covering integrally, above the upper face of the upper bearing, a space around the rotating shaft and a space above the upper through hole.

5. The expander-integrated compressor according to claim 3, wherein the bearing has a lower bearing that supports a portion of the lower rotating portion located below the cylinder, a lower through hole extending from the rear chamber to a bottom face of the lower bearing is formed in the lower bearing, and the upper through hole, the rear chamber, and the lower through hole configure a return passage that guides the oil located on an upper face of the upper bearing to the oil reservoir.

6. The expander-integrated compressor according to claim 2, wherein the bearing has an upper bearing that supports a portion of the lower rotating portion located above the cylinder, an upper communication hole extending from the first oil supply passage to the rear chamber is formed inside the upper bearing, and at least a part of the second oil supply passage is configured by the upper communication hole.

7. The expander-integrated compressor according to claim 2, wherein the bearing has a lower bearing that supports a portion of the lower rotating portion located below the cylinder, a lower communication hole extending from the first oil supply passage to the rear chamber is formed inside the lower bearing, and at least a part of the second oil supply passage is configured by the lower communication hole.

8. The expander-integrated compressor according to claim 2, wherein the bearing has an upper bearing that supports a portion of the lower rotating portion located above the cylinder, and the expansion mechanism includes a return passage that guides the oil located on an upper face of the upper bearing to the oil reservoir.

9. The expander-integrated compressor according to claim 8, wherein the bearing has a lower bearing that supports a portion of the lower rotating portion located below the cylinder, a through hole penetrating integrally through the upper bearing, the cylinder, and the lower bearing further is provided, and the return passage is configured by the through hole.

10. The expander-integrated compressor according to claim 9, further comprising a cover for covering integrally, above the upper face of the upper bearing, a space around the rotating shaft and a space above the through hole.

11. The expander-integrated compressor according to claim 2, wherein the first oil supply passage is formed in an outer circumferential surface of the lower rotating portion or in an inner circumferential surface of the bearing and is configured by a groove extending spirally from a lower side toward an upper side.

12. The expander-integrated compressor according to claim 2, wherein a third oil supply passage for guiding the oil drawn by the suction mechanism to the compression mechanism is formed inside the rotating shaft.

13. The expander-integrated compressor according to claim 1, further comprising an upper bearing for supporting a portion of the lower rotating portion located above the cylinder, and an upper cover placed above the upper bearing inside the closed casing, and for covering an upper side of at least a part of the upper bearing.

14. The expander-integrated compressor according to claim 13, wherein the upper cover includes a disk-shaped plate-like body fixed to the rotating shaft.

15. The expander-integrated compressor according to claim 13, wherein the upper cover is inclined downward toward the radially outer side of the rotating shaft.

16. The expander-integrated compressor according to claim 1, further comprising a lower cover for separating the oil contained in the oil reservoir from the expansion mechanism, wherein the lower cover has a bottom plate located below the expansion mechanism and a side plate that rises upward or obliquely upward from an outer circumference portion of the bottom plate and that extends to a higher position than that of a lower end of the expansion mechanism.

* * * * *